US012134492B2

(12) United States Patent
Graham et al.

(10) Patent No.: US 12,134,492 B2
(45) Date of Patent: Nov. 5, 2024

(54) SYSTEMS AND METHODS FOR PACKAGING STACKED PRODUCTS

(71) Applicant: WESTROCK SHARED SERVICES, LLC, Atlanta, GA (US)

(72) Inventors: Thomas Dean Graham, Winter Garden, FL (US); Amer Aganovic, Orlando, FL (US); Kirk S. Kempnich, Oviedo, FL (US); Claudio D'Alesio, Windermere, FL (US); Lonnie Teston, Edgewater, FL (US)

( * ) Notice: Subject to any disclaimer, the term of this patent is extended or adjusted under 35 U.S.C. 154(b) by 0 days.

(21) Appl. No.: 17/067,404

(22) Filed: Oct. 9, 2020

(65) Prior Publication Data

US 2022/0111986 A1 Apr. 14, 2022

(51) Int. Cl.

| | |
|---|---|
| ***B65B 35/52*** | (2006.01) |
| ***B65B 35/54*** | (2006.01) |
| ***B65B 41/06*** | (2006.01) |

(52) U.S. Cl.

CPC ..... *B65B 35/52* (2013.01); *B65B 35/54* (2013.01); *B65B 41/06* (2013.01)

(58) Field of Classification Search

CPC ..... B65B 35/52; B65B 35/54; B65B 35/30; B65B 35/50; B65B 41/06

See application file for complete search history.

(56) References Cited

U.S. PATENT DOCUMENTS

| | | | |
|---|---|---|---|
| 1,873,480 | A | 8/1932 | Richards |
| 2,274,847 | A | 3/1942 | Pattison |
| 2,677,221 | A | 5/1954 | Cleveland et al. |
| 2,857,040 | A | 10/1958 | Campbell |
| 2,868,141 | A | 1/1959 | Griner |
| 2,876,603 | A | 3/1959 | Zawaski |
| 3,050,175 | A | 8/1962 | Jeddeloh |
| 3,137,029 | A | 6/1964 | De Zolt |
| 3,330,423 | A | 7/1967 | Kirkhof |
| 3,367,823 | A | 2/1968 | Clausen et al. |

(Continued)

FOREIGN PATENT DOCUMENTS

| | | | |
|---|---|---|---|
| CN | 100475514 | C | 4/2009 |
| WO | 2003045678 | A2 | 6/2003 |

(Continued)

*Primary Examiner* — Anne Marie Antonucci

*Assistant Examiner* — Luis G Del Valle

(74) *Attorney, Agent, or Firm* — Neil G. Cohen; Rohini K. Garg

(57) ABSTRACT

A packaging system includes a plurality of feed conveyors configured to carry a plurality of carton units thereon and a stacking station. The stacking station includes a stacking conveyor and a plurality of lifting assemblies. Each lifting assembly of the plurality of lifting assemblies is selectively moveable over the stacking conveyor and a corresponding feed conveyor of the plurality of feed conveyors. The packaging system further includes a controller communicatively coupled to the stacking conveyor and the plurality of lifting assemblies. The controller is configured to control a first lifting assembly of the plurality of lifting assemblies to retrieve a first carton unit from a first feed conveyor of the plurality of feed conveyors and control the first lifting assembly to deposit the first carton unit on the stacking conveyor in a stacked relationship with a second carton unit.

20 Claims, 19 Drawing Sheets

(56) References Cited

U.S. PATENT DOCUMENTS 3,544,410 A 12/1970 Best et al.
3,604,184 A 9/1971 Shuttleworth
3,617,054 A 11/1971 Schilling
3,757,486 A 9/1973 Feurston et al.
3,777,913 A 12/1973 Schieser et al.
3,805,943 A 4/1974 Warren
3,835,620 A 9/1974 Boltz et al.
3,866,763 A 2/1975 Alduk
3,920,128 A 11/1975 Baker
3,964,953 A 6/1976 Mitchard et al.
3,988,195 A 10/1976 Henderson
4,043,442 A 8/1977 Greenwell et al.
4,095,781 A 6/1978 Kistner et al.
4,109,801 A 8/1978 Uchida et al.
4,175,997 A 11/1979 Muller
4,184,800 A 1/1980 Uchida et al.
4,352,616 A 10/1982 Brenner
4,614,473 A 9/1986 Kwauka et al.
4,645,062 A 2/1987 Kopp
4,650,448 A 3/1987 Urso
4,717,371 A 1/1988 Everman et al.
4,720,227 A 1/1988 Eberle
4,728,093 A 3/1988 Eberle
4,784,380 A 11/1988 Eberle
4,822,236 A 4/1989 Inoue et al.
4,829,749 A 5/1989 Hiyama et al.
4,867,432 A 9/1989 Matta
4,925,225 A 5/1990 Dost
4,927,318 A 5/1990 Hayden et al.
4,932,930 A 6/1990 Coalier et al.
4,946,540 A 8/1990 Mitchard
5,333,721 A 8/1994 Stevie
5,443,150 A * 8/1995 Buchko ..... B65B 31/021 198/463.6
5,443,357 A 8/1995 Leeds et al.
5,447,487 A 9/1995 Alberto
5,480,278 A 1/1996 Morgan
5,656,006 A 8/1997 East et al.
5,656,007 A 8/1997 Olson et al.
5,681,252 A 10/1997 Ziegler
5,899,341 A 5/1999 Irita
5,951,238 A 9/1999 Duecker
5,980,440 A 11/1999 Mitman et al.
6,106,450 A 8/2000 Brittain
6,306,070 B1 10/2001 Herrin
6,543,600 B2 4/2003 Ouellette
6,691,857 B2 2/2004 Roda
6,773,385 B2 8/2004 Johnson et al.
6,904,733 B2 6/2005 Boix Jaen
6,955,518 B1 10/2005 Hagel
6,997,666 B1 2/2006 Rodgers et al.
7,331,915 B2 2/2008 Coullery et al.
7,381,176 B2 6/2008 Graham et al.
7,682,300 B2 3/2010 Graham et al.
7,909,159 B1 3/2011 Zats et al.
8,024,910 B2 9/2011 Graham et al.
8,105,223 B2 1/2012 Graham et al.
8,128,547 B2 3/2012 Graham et al.
8,133,163 B2 3/2012 Strong et al.
8,409,064 B2 4/2013 Desertot et al.
8,647,247 B2 2/2014 Pazdernik et al.
8,650,835 B2 2/2014 Sandor
8,939,352 B2 1/2015 Delause et al.
9,114,897 B2 8/2015 Kim et al.
9,365,361 B1 6/2016 Skarlupka
9,409,367 B2 8/2016 Graham et al.
9,486,972 B2 11/2016 Mack et al.
9,555,609 B2 1/2017 Tyler
9,969,565 B1 * 5/2018 Simm ..... B65B 35/38
9,979,041 B2 5/2018 Ju et al.
10,155,352 B2 * 12/2018 Sytema ..... B31B 50/262
10,532,894 B2 1/2020 Kuhn
10,543,945 B2 * 1/2020 Sytema ..... B65B 5/024
10,640,303 B2 5/2020 Kuhn
2003/0062246 A1 4/2003 Roda
2003/0100420 A1 5/2003 Lund et al.
2004/0031236 A1 2/2004 Boix Jaen
2005/0079965 A1 4/2005 Moshier et al.
2005/0092581 A1 5/2005 Walker
2005/0102940 A1 * 5/2005 Tyler ..... E06B 3/72 52/741.1
2006/0068981 A1 3/2006 Coullery et al.
2006/0100079 A1 5/2006 Graham et al.
2007/0037682 A1 2/2007 Scholtes et al.
2007/0098540 A1 * 5/2007 Hendricks ..... B65H 31/3054 414/788.1
2007/0191201 A1 8/2007 Reuteler et al.
2008/0067225 A1 3/2008 Moore
2008/0078819 A1 4/2008 Strong
2008/0142407 A1 6/2008 Moore
2009/0098991 A1 4/2009 Graham et al.
2010/0069209 A1 3/2010 Jannin et al.
2010/0263333 A1 10/2010 Langen
2011/0053746 A1 3/2011 Desertot et al.
2011/0107725 A1 * 5/2011 Sperry ..... B65B 59/003 53/553
2011/0281705 A1 11/2011 Aganovic et al.
2012/0122640 A1 5/2012 Pazdernik et al.
2014/0102044 A1 4/2014 Berglin et al.
2014/0113787 A1 4/2014 Aganovic et al.
2014/0371045 A1 12/2014 Bruneau et al.
2015/0324893 A1 * 11/2015 Langen ..... B65B 43/265 705/26.81
2016/0176142 A1 6/2016 Couture et al.
2016/0362208 A1 * 12/2016 Papsdorf ..... B65G 47/53
2017/0080666 A1 3/2017 Graham et al.
2017/0282478 A1 10/2017 Strong et al.
2017/0320608 A1 11/2017 Schuster
2020/0255228 A1 8/2020 Yasuda et al.
2021/0138756 A1 * 5/2021 Langen ..... B65B 43/126
2022/0048658 A1 * 2/2022 Langen ..... G06Q 50/28

FOREIGN PATENT DOCUMENTS

WO 2003045678 A3 2/2004
WO 2019079210 A1 4/2019

* cited by examiner

SYSTEMS AND METHODS FOR PACKAGING STACKED PRODUCTS

BACKGROUND

This disclosure relates generally to systems and methods for packaging stacked products, and more specifically to systems and methods for forming a packaging assembly that includes stacked products each packaged within a carton wherein the stacked products are further packaged within a shipping container.

In today's world of shipping products to retail stores, it is common for at least some products to be shipped in bulk containers to stores, such as an outlet store or supermarket. Containers for shipping goods are typically made in standard or predetermined sizes, and then are used to ship the goods therein. At least some known containers may be configured to protect a plurality of individual cartons packaged within the container. However, at least some known containers are not configured to display and/or provide access to the cartons in the retail store. Accordingly, retailers may need to provide a separate container to display the packaged goods within the store for easy access to customers and the shipping container may be discarded after opening. As a result, some such containers may require additional containers or devices to display the packaged goods to consumers. Additionally, some such containers may also result in additional time being spent by retail store staff to coordinate and organize display of the packaged goods within the retail store for easy access by consumers.

Therefore, there is a need for shipping containers that protect the products included therein, including any packaging (e.g., cartons) that package the individual products, and can be used to display the packaged goods after the container has been received. The need for special containers is increasing with a growing demand for displaying goods in the containers that they were shipped in, especially at outlet stores and supermarkets. In particular, there is a need for containers that may contain one or more stacked cartons during shipping and are configured to be efficiently converted to provide access to the cartons for display at outlet stores and supermarkets. In addition, there is a need for a system that can quickly make packaging assemblies including such containers.

BRIEF DESCRIPTION

In one embodiment, a packaging system is provided. The packaging system includes a plurality of feed conveyors configured to carry a plurality of carton units thereon and a stacking station. The stacking station includes a stacking conveyor and a plurality of lifting assemblies. Each lifting assembly of the plurality of lifting assemblies is selectively moveable over the stacking conveyor and a corresponding feed conveyor of the plurality of feed conveyors. The packaging system further includes a controller communicatively coupled to the stacking conveyor and the plurality of lifting assemblies. The controller is configured to control a first lifting assembly of the plurality of lifting assemblies to retrieve a first carton unit from a first feed conveyor of the plurality of feed conveyors and control the first lifting assembly to deposit the first carton unit on the stacking conveyor in a stacked relationship with a second carton unit.

In another embodiment, a method for forming a plurality of carton unit stacks using a packaging system is provided. The packaging system includes a plurality of feed conveyors and a stacking station including a stacking conveyor and a plurality of lifting assemblies. The lifting assemblies are each selectively moveable over the stacking conveyor and a corresponding feed conveyor of the plurality of feed conveyor. The method includes providing a first carton unit on a first feed conveyor of the plurality of feed conveyors. The method further includes retrieving, by a first lifting assembly of the plurality of lifting assemblies, the first carton unit from the first feed conveyor and depositing, by the first lifting assembly, the first carton unit on the stacking conveyor in a stacked relationship with a second carton unit.

In yet another embodiment, a packaging system is provided. The packaging system includes a plurality of feed conveyors configured to carry a plurality of carton units thereon and a stacking station including a stacking conveyor and a plurality of lifting assemblies. Each lifting assembly of the plurality of lifting assemblies is selectively moveable along a track over the stacking conveyor and a corresponding feed conveyor of the plurality of feed conveyors. A controller is communicatively coupled to the stacking conveyor and the plurality of lifting assemblies. The controller is configured to control a first lifting assembly of the plurality of lifting assemblies to retrieve a first carton unit in a first orientation from a first feed conveyor of the plurality of feed conveyors. The controller is further configured to control the first lifting assembly to rotate the first carton unit from the first orientation to a second orientation and control the first lifting assembly to deposit the first carton unit on the stacking conveyor in the second orientation.

DETAILED DESCRIPTION

The systems and methods described herein include machines for packaging stacked products that overcome the limitations of known systems and methods for packaging stacked products. The system described herein includes a plurality of feed conveyors configured to carry a plurality of carton units, and a stacking station that includes a stacking conveyor and a plurality of lifting assemblies. The carton units may include carton blanks that are at least partially wrapped around a product, such as a food product container. The lift assemblies are selectively moveable over the stacking conveyor and a corresponding feed conveyor. A controller is communicatively coupled to the feed conveyors and the stacking station to control each lifting assembly to retrieve carton units from the corresponding feed conveyors and deposit the carton units on the stacking conveyor. The stacking conveyor is configured to be selectively indexed, thereby moving at least one deposited carton into alignment with an adjacent lifting assembly, such that the adjacent lifting assembly may deposit an additional carton unit in a stacked relationship with the at least one other deposited carton.

Figure 1:
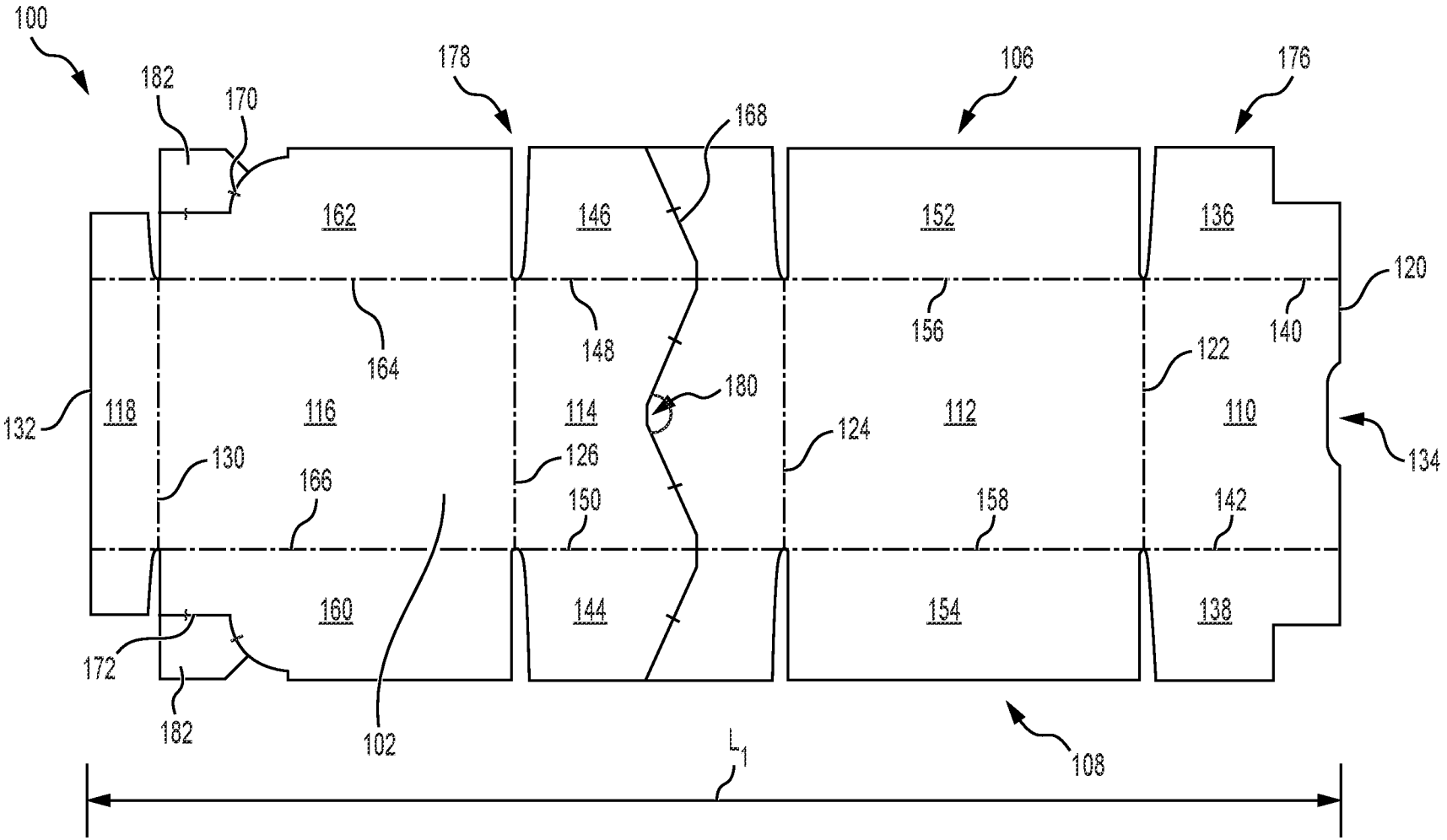
FIG. 1 is a schematic top plan view of a container blank.

FIG. 1 is a schematic top plan view of a container blank 100. As shown in FIG. 1, container blank 100 has an interior surface 102 and an exterior surface 104 (shown in FIG. 3). In certain embodiments, portions of exterior surface 104 and/or interior surface 102 of container blank 100 include printed graphics, such as advertising and/or promotional materials.

In the example embodiment, container blank 100 extends from a leading edge 106 to a trailing edge 108 and includes a series of aligned side panels connected together by a plurality of preformed, generally parallel, fold lines defined generally perpendicular to leading edge 106 and trailing edge 108. Specifically, the side panels include a first side panel 110, a first end panel 112, a second side panel 114, a second end panel 116, and a lip panel 118 connected in series along a plurality of parallel fold lines. First side panel 110 extends from a first free edge 120 to a fold line 122, first end panel 112 extends from first side panel 110 along fold line 124, second side panel 114 extends from first end panel 112 along fold line 126, second end panel 116 extends from second side panel 114 along fold line 128, and lip panel 118 extends from second end panel 116 along fold line 130 to a second free edge 132. First free edge 120 defines a notch 134. Container blank 100 has a length $L_1$ defined between first free edge 120 and second free edge 132.

A first top side panel 136 and a first bottom side panel 138 extend from opposing edges of first side panel 110. More specifically, first top side panel 136 and first bottom side panel 138 extend from first side panel 110 along a pair of opposing preformed, generally parallel, fold lines 140 and 142, respectively. Similarly, a second bottom side panel 144 and a second top side panel 146 extend from opposing edges of second side panel 114. More specifically, second bottom side panel 144 and second top side panel 146 extend from second side panel 114 along a pair of opposing preformed, generally parallel, fold lines 150 and 148, respectively. Fold lines 140, 142, 148, 150 are generally parallel to each other and generally perpendicular to fold lines 122, 124, 126, 130.

As shown in FIG. 1, a first top end panel 152 and a first bottom end panel 154 extend from opposing edges of first end panel 112. More specifically, first top end panel 152 and first bottom end panel 154 extend from first end panel 112 along a pair of opposing preformed, generally parallel, fold lines 156 and 158, respectively. Similarly, a second bottom end panel 160 and a second top end panel 162 extend from opposing edges of second end panel 116. More specifically, second bottom end panel 160 and second top end panel 162 extend from second end panel 116 along a pair of opposing preformed, generally parallel, fold lines 166 and 164, respectively. Fold lines 156, 158, 164, 166 are generally parallel to each other and generally perpendicular to fold lines fold lines 122, 124, 126, 130.

Figure 4:
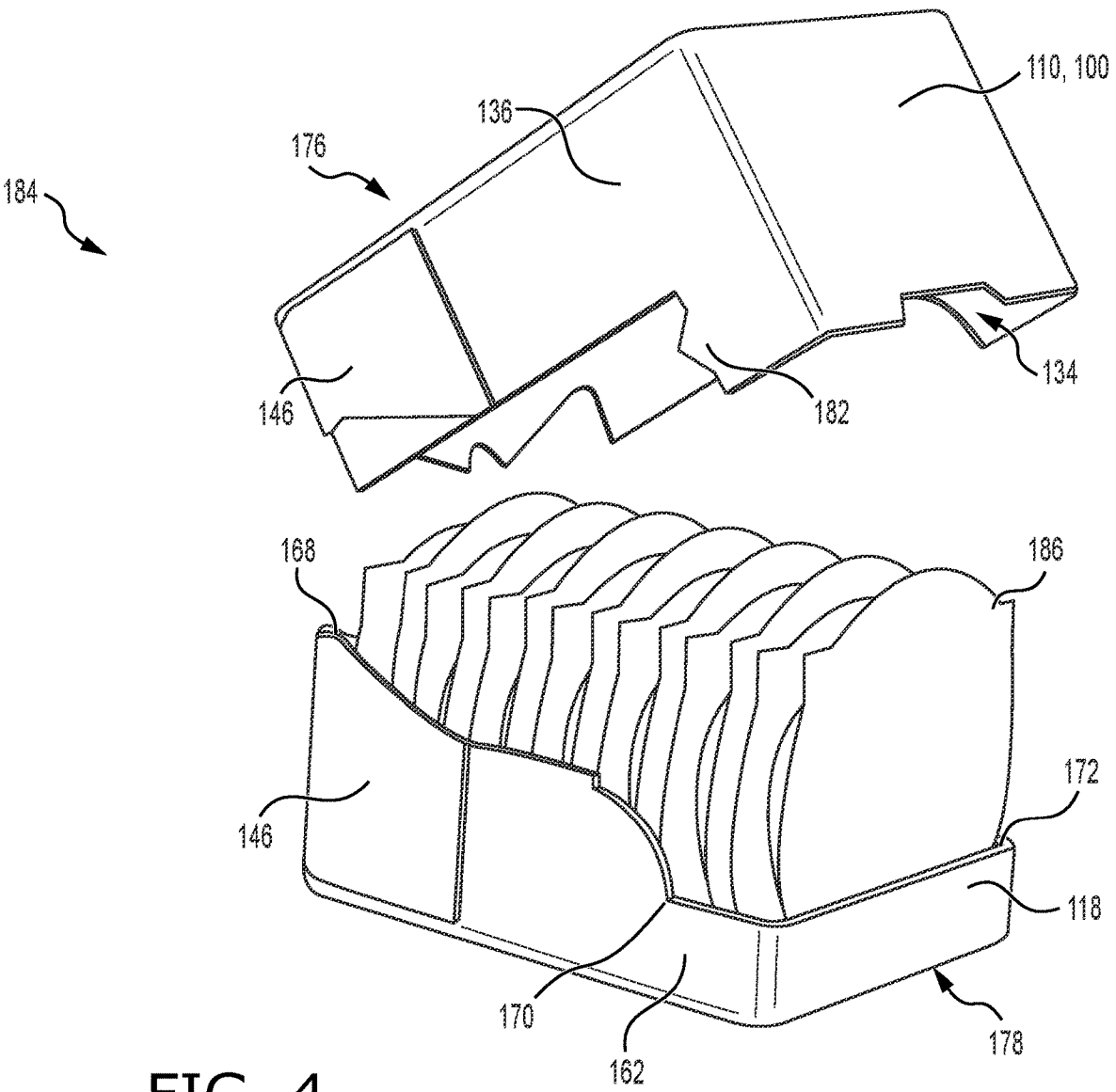
FIG. 4 is schematic perspective view of the packaging assembly shown in FIG. 2 in a torn configuration.

In the example embodiment, container blank 100 includes a plurality of tear lines 168, 170, 172 that facilitate separating container blank 100 into an upper portion, generally indicated at 176, and a lower portion, generally indicated at 178, when container blank 100 is folded into an assembled configuration (shown in FIG. 4). More specifically, a first tear line 168 extends along second bottom side panel 144, second side panel 114, and second top side panel 146 from leading edge 106 to trailing edge 108. First tear line 168 has a generally "zig-zag" shape between leading edge 106 and trailing edge 108 and includes sections that are oriented obliquely relative to trailing edge 108 and leading edge 106. An aperture 180 is defined within second side panel 114 proximate a midpoint of first tear line 168. In the example embodiment, second top end panel 162 and second bottom end panel 160 also include tear lines 170, 172 defining a periphery of a pair of tabs 182.

Of course, container blanks having shapes, sizes, and configurations different from container blank 100 described and illustrated herein may be used in packaging system 200 (shown in FIG. 5) without departing from the scope of the present disclosure. For example, container blank 100 is shown as a four-sided container, but could be a six-sided container, an eight-sided container, or an N-sided container without departing from the scope of this disclosure.

Figure 2:
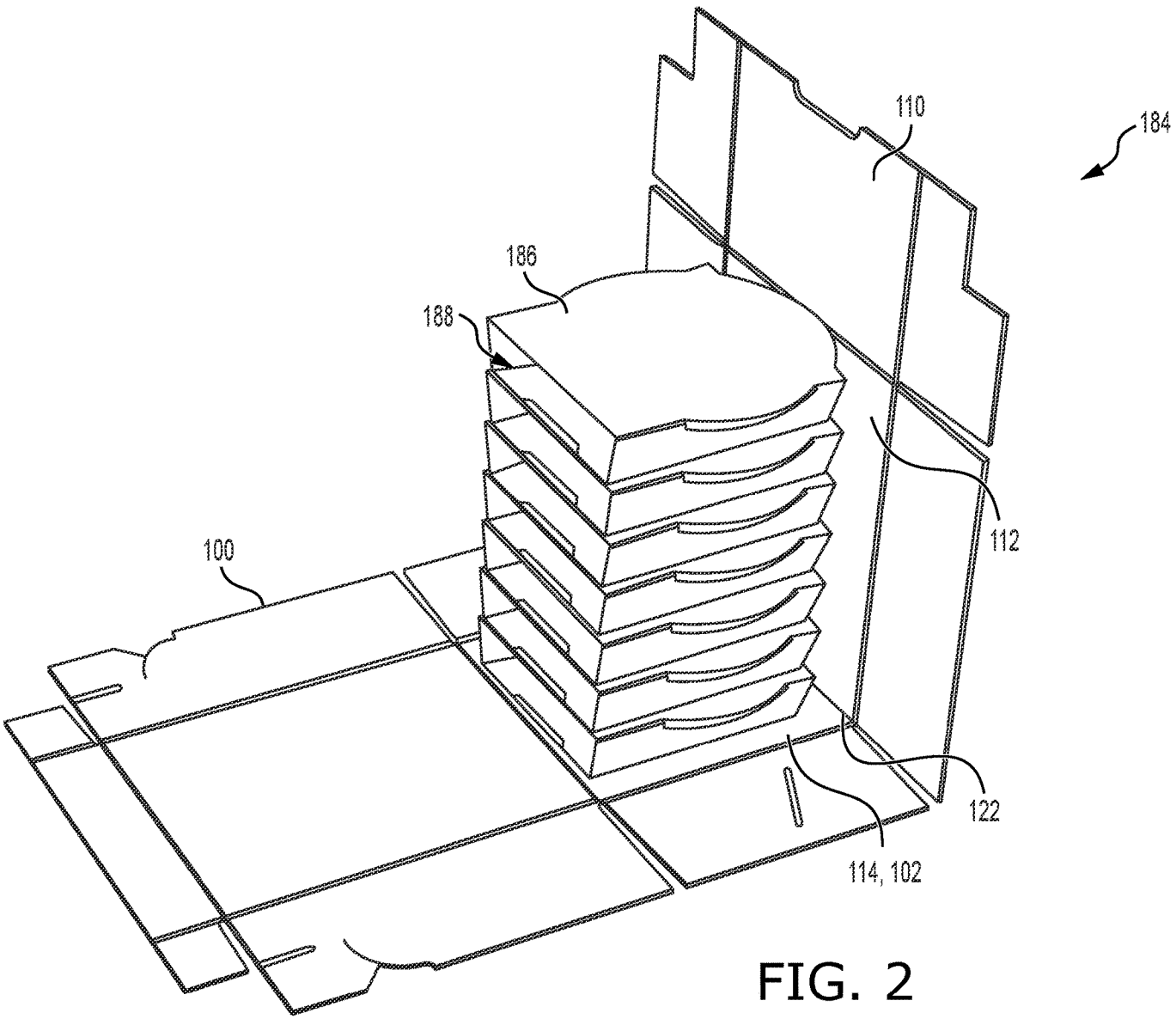
FIG. 2 is a schematic perspective view of a packaging assembly including a plurality of cartons and the container blank shown in FIG. 1.

FIG. 2 is a schematic perspective view of a packaging assembly 184 including a plurality of cartons 186, or more broadly "trays," and container blank 100 shown in an "L" configuration. Container blank 100 is sized to contain cartons 186 therein. Container blank 100 is configured to be folded around cartons 186 by first receiving cartons 186 in the "L" configuration. In the example embodiment, each carton 186 of the plurality of cartons 186 has the same shape and defines a cavity indicated generally at 188. Cavity 188 is sized to receive a frozen food container (not shown) therein. More specifically, in the example embodiment, cartons 186 are each sized to receive a frozen bowl within cavities 188. In alternative embodiments cartons 186 have a variety of different shaped and sized cartons 186.

In the example embodiment, cartons 186 are successively stacked on second side panel 114 of interior surface 102 of container blank 100. In particular, in the example embodiment, plurality of cartons 186 includes seven cartons 186 stacked on second side panel 114. In alternative embodiments, container blank 100 is sized to receive a plurality of stacks (not shown) of cartons 186 therein. In the "L" configuration, container blank 100 is folded along fold line 122 such that first end panel 112 and first side panel 110 are transversely oriented relative to second side panel 114 and second end panel 116 (shown in FIG. 1). First end panel 112 is sized such that, in the "L" configuration, first end panel 112 extends at least to or above plurality of cartons 186.

Figure 3:
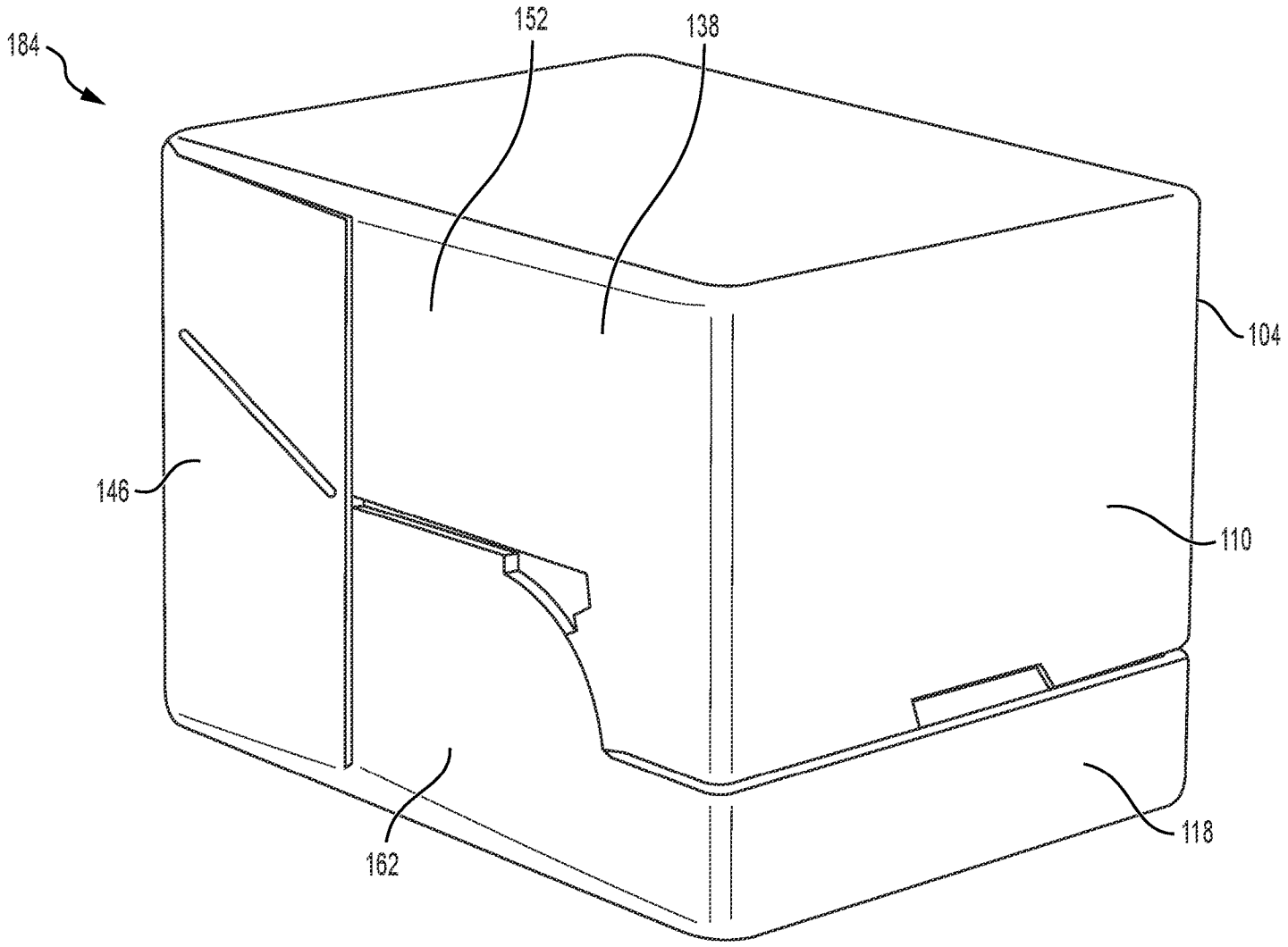
FIG. 3 is a schematic perspective view of the packaging assembly shown in FIG. 2 in an assembled configuration.

FIG. 3 is a schematic perspective view of packaging assembly 184 in an assembled configuration. FIG. 4 is a schematic perspective view of packaging assembly 184 shown in a separated configuration. Referring to FIG. 3, in the assembled configuration, container blank 100 substantially surrounds cartons 186 (shown in FIG. 2) such that cartons 186 are contained within container blank 100 and face interior surface 102 (shown in FIG. 1). First side panel 110 is folded inward and abuts lip panel 118. First top side panel 136 (shown in FIG. 1) and second top side panel 146 are each folded inward outside of first top end panel 152 (shown in FIG. 1) and second top end panel 162. First bottom side panel 138, first bottom end panel, second bottom side panel 144 (shown in FIG. 1), and second bottom end panel 160 (shown in FIG. 1) are arranged in substantially the same manner as first top side panel 136, first top end panel 152, second top side panel 146, and second top end panel 162, respectively. In the example embodiment, first top side panel 136 and first bottom side panel 138 are both adhesively coupled to respective tabs 182 (shown in FIG. 1) of second top end panel 162 and second bottom end panel 160.

Referring to FIG. 4, in the example embodiment, tear lines 168, 170, 172 enable selectively separating container blank 100 into an upper portion 176 and a lower portion 178 to provide access to cartons 186. In particular, in some embodiments, an end user may separate upper portion 176 from lower portion 178 by engaging first side panel 110 at notch 134 and pulling upward to tear tabs 182 along tear lines 170, 172 from second top end panel 162 and second bottom end panel 160 (shown in FIG. 1). Additionally, tear line 168 extending along second top side panel 146, second side panel 114 (shown in FIG. 1), and second bottom side panel 144 (shown in FIG. 1) may be used to separate the top portion from the bottom portion. In alternative embodiments, container blank 100 is configured to be separated in any manner that enables container blank 100 to function as described herein.

In the example embodiment, upper portion 176 includes first side panel 110, first end panel 112 (shown in FIG. 1), first top side panel 136, first bottom side panel 138 (shown in FIG. 1), tabs 182, and portions of second top side panel 146 second side panel 114 (shown in FIG. 1) and second bottom side panel 144 (shown in FIG. 1). Lower portion 178 holds cartons 186 and includes lip panel 118, second end panel 116 (shown in FIG. 1), second top end panel 162, second bottom end panel 160 (shown in FIG. 1), and the remaining portions of second side panel 114 (shown in FIG. 1), second top side panel 146, and second bottom side panel 144 (shown in FIG. 1).

Figure 5:
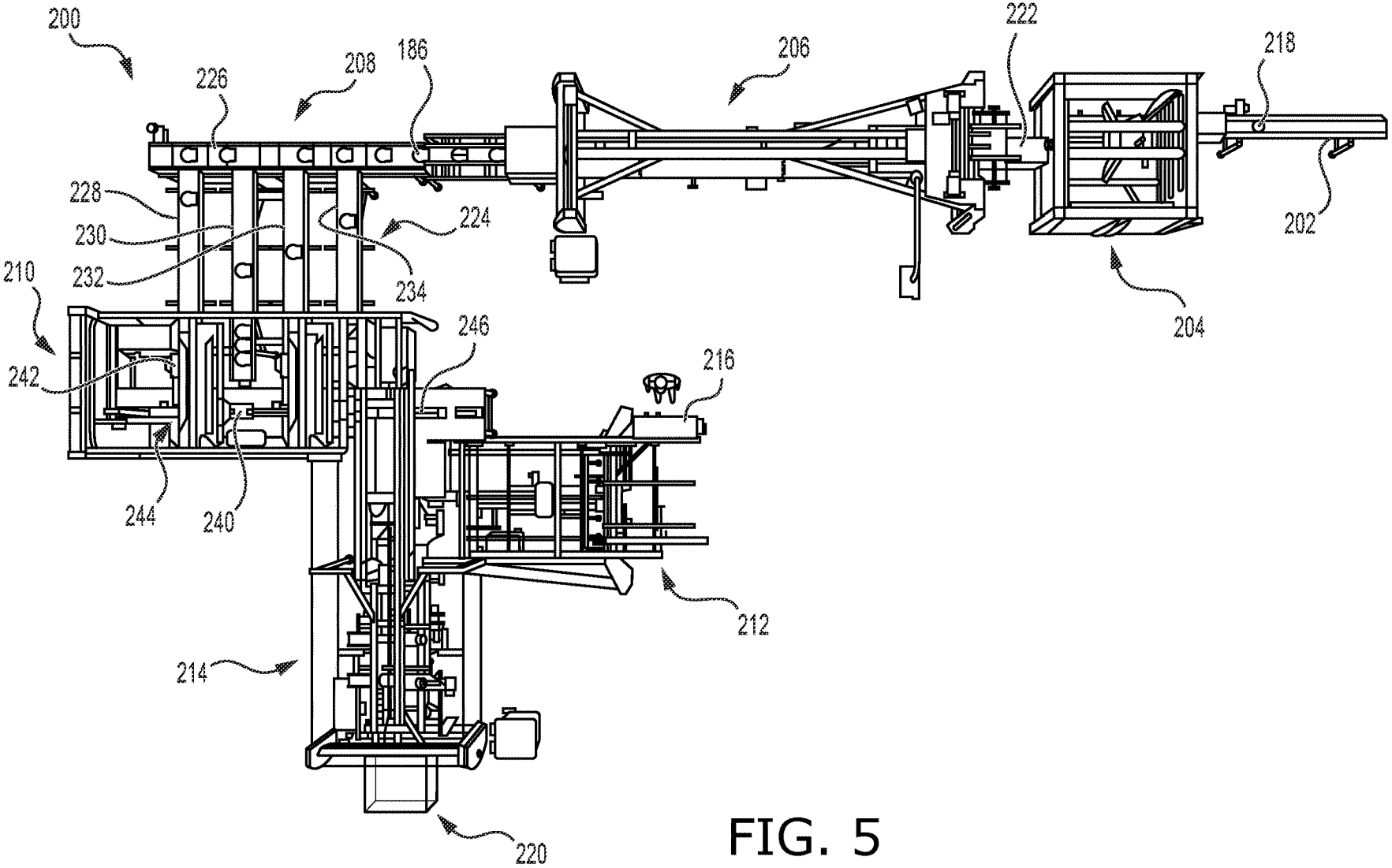
FIG. 5 is a schematic top view of a packaging system that may be used to form the packaging assembly shown in FIGS. 2-4.

FIG. 5 a schematic top view of a packaging system 200 that may be used to form the packaging assembly 184, shown in FIGS. 2-4. Packaging system 200 includes an input conveyor 202, a bowl loading station 204, a carton wrapping station 206, a line dividing conveyor 208, a stacking station 210, a container loading station 212, and a container wrapping station 214. Directional arrows used in FIG. 5 indicate directional flow of materials through packaging system 200 forming packaging assembly 184. A control system 216 is coupled in operative control communication with certain components of packaging system 200. Packaging system 200 is configured to receive a food container 218 (e.g., a frozen food bowl), carton blanks 186, and container blanks 100 as inputs and output packaging assembly 184 (shown in FIG. 3) in the assembled configuration. Food containers 218 (e.g., a frozen food bowl) are loaded on input conveyor 202, carton blanks 186 are loaded at carton wrapping station 206, and container blanks 100 (shown in FIG. 1) are loaded at container loading station 212. Packaging assembly 184 (shown in FIG. 3) is output at an endpoint 220 of container wrapping station 214.

In the example embodiment, input conveyor 202 directs food containers 218 into bowl loading station 204. Bowl loading station 204 includes a line conveyor 222 that is offset from input conveyor 202. Bowl loading station 204 is configured to transfer food containers 218 from input conveyor 202 to line conveyor 222 such that food containers 218 are substantially evenly spaced on line conveyor 222. Food containers 218 are directed on line conveyor 222 into carton wrapping station 206. Carton wrapping station 206 is configured to receive carton blanks 186 and food containers 218 and wrap carton blanks 186 around food containers 218 such that cartons 186 exit carton wrapping station 206 in an assembled configuration (e.g. as shown in FIG. 2).

In the example embodiment, after exiting carton wrapping station 206, cartons 186 are directed onto a line dividing conveyor 208 configured to direct cartons 186 onto one of a plurality of feed conveyors 224. In the example embodiment, line dividing conveyor 208 includes an output conveyor 226 positioned in line with line conveyor 222 and plurality of feed conveyors 224 are oriented substantially transversely to output conveyor 226. Output conveyor 226 is configured to receive cartons 186 output from carton wrapping station 206. Feed conveyors 224 direct cartons 186 from output conveyor 226 to stacking station 210. More specifically, feed conveyors 224 each include a gate 236 (shown in FIG. 8) configured to hold cartons 186 on feed conveyors 224 in stacking queues at gates 236. In the example embodiment plurality of feed conveyors 224 includes a first feed conveyor 228, a second feed conveyor 230, a third feed conveyor 232, and a fourth feed conveyor 234. In alternative embodiments, packaging system 200 may include any number of feed conveyors 224 that enable line dividing conveyor 208 to function as described herein.

In the example embodiment, line dividing conveyor 208 is configured to direct cartons 186 from output conveyor 226 onto feed conveyors 224 based at least in part on the number of cartons 186 in stacking queues for each line. For example, in some embodiments, line dividing conveyor 208 includes at least one sensor (not shown) configured to detect a number of cartons 186 in each feed conveyor 224. In such embodiments, line dividing conveyor 208 is configured to direct cartons 186 onto one of feed conveyors 224 based at least in part on the detected number of cartons 186 in each of feed conveyors 224 to ensure a substantially equal distribution of cartons 186 are apportioned among feed conveyors 224. In particular, line dividing conveyor 208 is configured to direct cartons 186 onto feed conveyors 224 such that each feed conveyor 228-234 has at least one carton 186 in the respective stacking queue at all times during operation. For example, where sensors (not shown) detect that fourth feed conveyor 234 includes the lowest number of cartons 186 in stacking queue, line dividing conveyor 208 is configured to direct a next carton 186 from output conveyor 226 to fourth feed conveyor 234. In alternative embodiments, line dividing conveyor 208 is configured to direct cartons 186 from output conveyor 226 to feed conveyors 224 in any manner that enables packaging system 200 to function as described herein.

In the example embodiment, stacking station 210 includes a stacking conveyor 240 oriented substantially transversely to feed conveyors 224 and substantially parallel to output conveyor 226. Stacking station is configured to transfer cartons 186 from feed conveyors 224 onto stacking conveyor 240. In the example embodiment, stacking conveyor 240 is an intermittent conveyor configured to operate in discrete movements. A plurality of lifting assemblies 242 are configured to lift cartons 186 from stacking queue and deposit cartons 186 on stacking conveyor 240. More specifically, in the example embodiment, stacking station 210 includes four lifting assemblies 242 each corresponding to a respective feed conveyor 224. Stacking conveyor 240 directs cartons 186 between a first end 244, proximate first feed conveyor 228, to a second end 246 proximate container wrapping station 214. Lifting assemblies 242 are configured to deposit cartons 186 in stacked configuration on stacking conveyor 240. For example, cartons 186 from fourth feed conveyor 234 are transferred onto stacking conveyor 240 on top of a stack of cartons (not shown) including cartons 186 transferred from first, second, and third conveyors 228, 230, 232.

In the example embodiment, container loading station 212 is configured to receive container blanks 100 (shown in FIG. 1), fold container blanks 100 into the L-configuration (shown in FIG. 2) and move folded container blanks 100 to the container wrapping station 214. At container wrapping station 214, stacked cartons 186 from stacking conveyor 240 are directed onto second side panel 114 (shown in FIG. 1) of container blanks 100 in the L-configuration, and container blanks 100 are wrapped and sealed around stacked cartons 186 such that packaging assemblies 184 (shown in FIG. 3) reach endpoint 220 in the assembled configuration.

Figure 6:
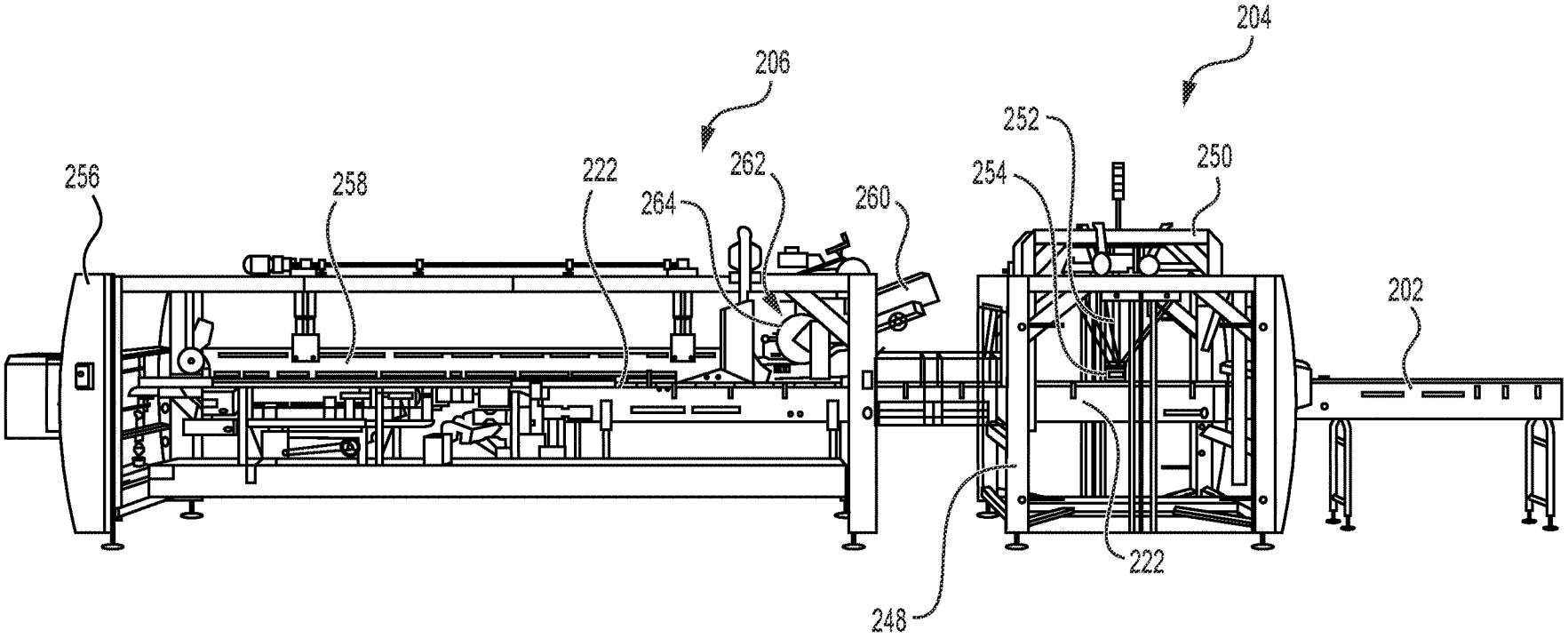
FIG. 6 is a schematic side view of an input conveyor, a bowl loading station, and a carton wrapping station of the packaging system shown in FIG. 5.

FIG. 6 is a schematic side view of input conveyor 202, bowl loading station 204, and carton wrapping station 206. In the example embodiment, input conveyor 202 is a belt conveyor and carries food containers 218 (shown in FIG. 5) into bowl loading station 204. Bowl loading station 204, also referred to as a "delta pick station," includes an outer housing 248 supporting an arm frame 250 above input conveyor 202. A robotic arm 252 is coupled to arm frame 250 and depends therefrom toward input conveyor 202. Line conveyor 222 is also provided within outer housing 248 offset from input conveyor 202. More specifically, in the example embodiment, input conveyor 202 is laterally (i.e., into the page as shown in FIG. 6) offset from line conveyor 222. Robotic arm 252 includes a gripping device 254 operable to engage food containers 218 (shown in FIG. 5) on input conveyor 202 and deposit them on line conveyor 222. In particular, in the example embodiment, robotic arm 252 is laterally moveable relative to outer housing 248 between input conveyor 202 and line conveyor 222. During operation, robotic arm 252 individually transfers food containers 218 from input conveyor 202 to line conveyor 222 such that food containers 218 are substantially evenly spaced on line conveyor 222. In the example embodiment, gripping device 254 includes a vacuum suction piece (not shown) that engages food containers 218 to transfer them from input conveyor 202 to line conveyor 222. In alternative embodiments, gripping device 254 may be any gripping device that enables bowl loading station 204 to function as described herein.

In the example embodiment, carton wrapping station 206, also referred to as a "cluster pack emerge station," includes an outer housing 256 extending around line conveyor 222 and a wrapping housing 258 disposed within outer housing 248. A carton blank input ramp 260 for receiving carton blanks 186 (shown in FIG. 2) extends through housing 256 to an applicator 262. Applicator 262 is configured to apply carton blanks 186 to food containers 218 entering on line conveyor 222. Applicator 262 may include a rotating drum 264 and at least one grabbing device (not shown) extending radially outward from a periphery of the rotating drum. For example, in some such embodiments, during operation the rotating drum moves the at least one grabbing device into position with a carton blank 186 (shown in FIG. 2) received from carton blank input ramp 260 and the grabbing device may engage the carton blank 186. The rotating drum 264 may then move grabbing device, now carrying carton blank 186 into position above a food container 218 on line conveyor 222 and deposit carton blank 186 on top of food container 218. In some such embodiments, line conveyor 222 further includes lugs (not shown) that travel with line conveyor 222 and maintain positioning of carton blanks 186 (shown in FIG. 2) on food containers 218 (shown in FIG. 5). In alternative embodiments, carton wrapping station 206 is configured to apply carton blank 186 to food container 218 in any manner that enables carton wrapping station 206 to function as described herein.

In the example embodiment, with each food container 218 having a carton blank 186 positioned thereon, food containers 218 are directed into a wrapping housing 258 configured to wrap carton blanks 186 around food containers 218 (shown in FIG. 2). In particular, with the carton blanks 186 positioned above food containers 218, wrapping housing 258 includes one or wrapping assemblies (not shown) which wrap side portions (not shown) of carton blanks 186 around food containers 218 and bottom of food containers 218. Wrapping housing 258 may further include one or more bonding assemblies (not shown) configured to adhesively bond portions of the wrapped carton blanks 186 such that carton blanks 186 are secured around food containers 218 upon exiting carton wrapping station 206.

Figure 7:
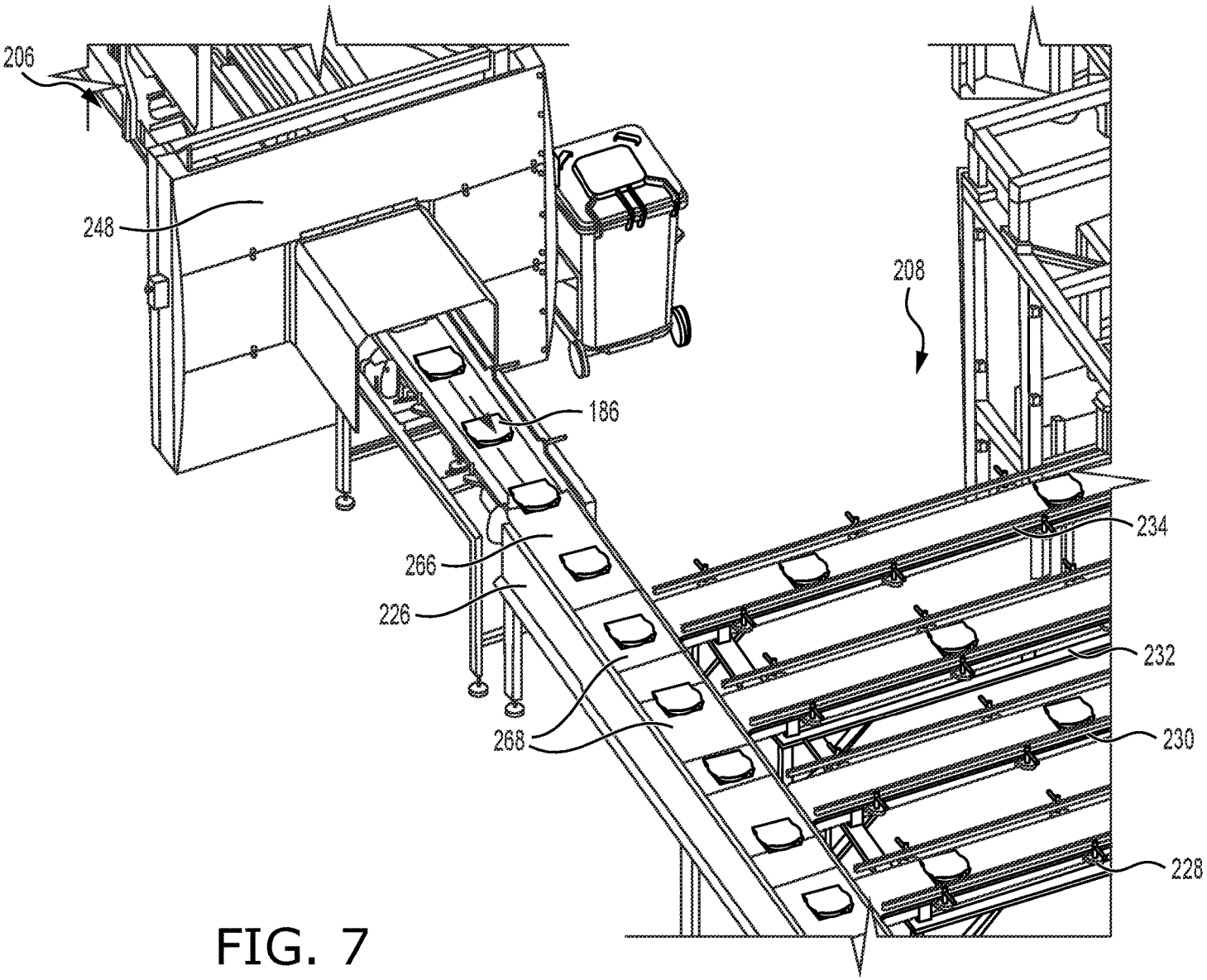
FIG. 7 is a schematic perspective view of a line dividing conveyor of the packaging system shown in FIG. 5.
Figure 8:
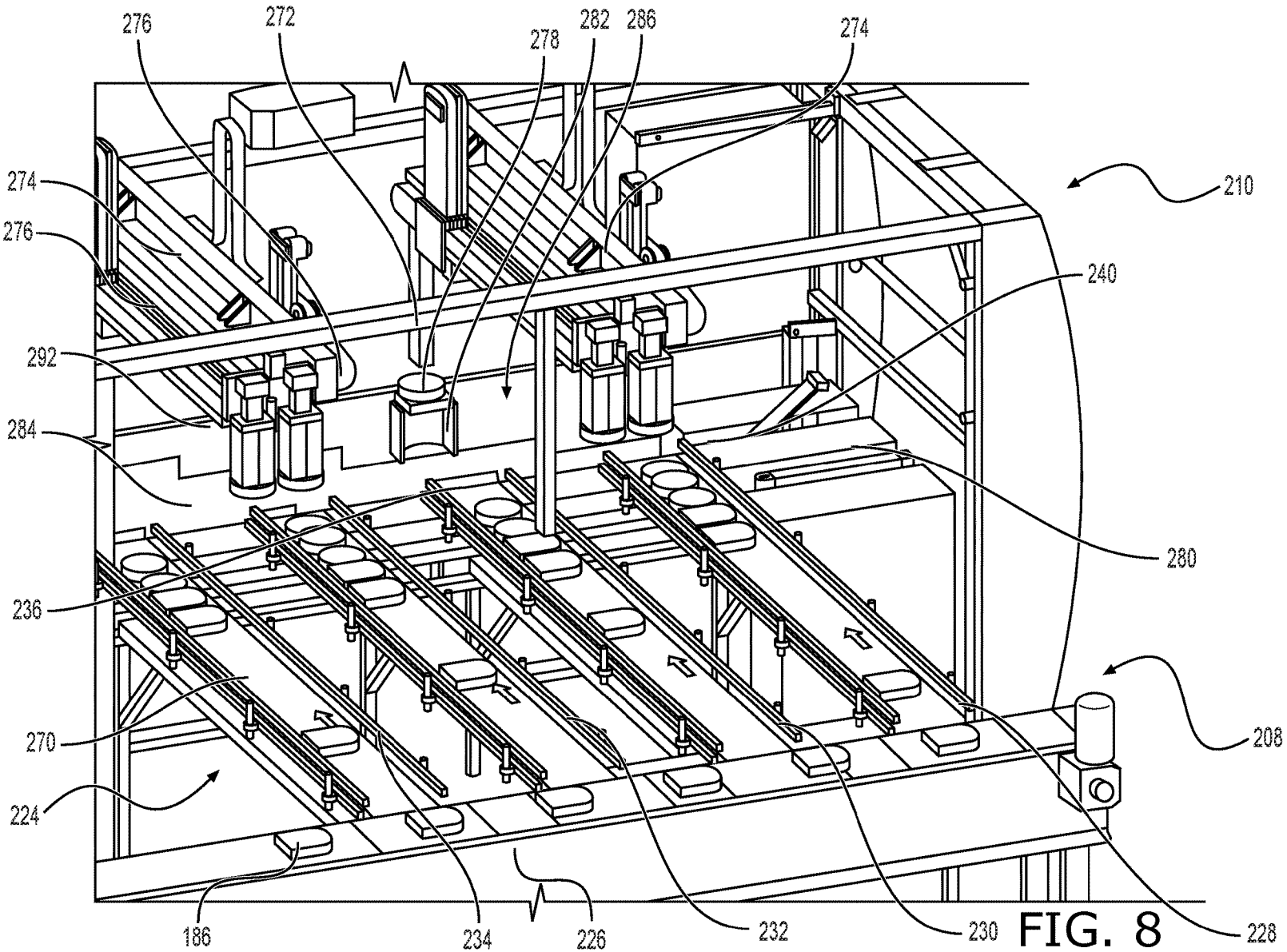
FIG. 8 is a schematic perspective view of the line dividing conveyor shown in FIG. 7 and a stacking station of the packaging system shown in FIG. 5.

FIG. 7 is a schematic perspective view of line dividing conveyor 208. FIG. 8 is a schematic perspective view of a portion of line dividing conveyor 208 and stacking station 210. Referring to FIG. 7, in the example embodiment, output conveyor 226 extends through outer housing 248 of carton wrapping station 206 and is positioned in line with line conveyor 222 (shown in FIG. 6) to receive wrapped cartons 186 from line conveyor 222. Although described herein as separate conveyors, in some alternative embodiments, line conveyor 222 and output conveyor 226 are a single conveyor.

In the example embodiment, output conveyor 226 is a roller belt transfer conveyor configured to selectively direct cartons 186 onto one of first, second, third, and fourth conveyors 228-234. In particular, in the example embodiment, output conveyor 226 includes a belt 266 carrying a plurality of rollers (not shown). Turn drives, indicated schematically at 268, are provided below belt 266 are configured to selectively drive the rollers carried on belt 266 to direct cartons 186 into one of feed conveyors 224. In alternative embodiments, output conveyor 226 is any conveyor that enables line dividing conveyor 208 to function as described herein.

Referring to FIG. 8, in the example embodiment, feed conveyors 224 are each belt conveyors and include belts 270 that direct cartons 186 from output conveyor 226 to gates 236. Gates 236 are configured to maintain cartons 186 on feed conveyors 224 while belts 270 are in continuous motion. In the example embodiment, four cartons 186 are queued at gates 236 of each feed conveyor 224.

In the example embodiment, stacking station 210 includes a frame 272 having a pair of lift bars 274 extending over stacking conveyor 240 and feed conveyors 224. A pair of tracks 276 are coupled to opposed sides of each lift bar 274 and extend between stacking conveyor 240 and a respective feed conveyor 224. Lifting assemblies 242 are each coupled to and moveable along a respective track 276. In particular, in the example embodiment, stacking station 210 includes four lifting assemblies 242 each corresponding to a respective one of feed conveyors 224. Lifting assemblies 242 each include an arm assembly 292 having a gripping mechanism 278 configured to engage cartons 186 and move cartons 186 from feed conveyors 224 to stacking conveyor 240 as lifting assemblies 242 move along respective tracks 276. In particular, in the example embodiment, tracks 276 are coupled to lift bars 274 such that gripping mechanisms 278 are positionable in alignment over a respective feed conveyor 224.

In the example embodiment stacking station 210 includes base plates 280 and stacking conveyor 240 is positioned between base plates 280. In particular, in the example embodiment, stacking conveyor 240 is a chain conveyor and is configured for discrete intermittent movement relative to base plates 280. A plurality of guide paddles 282 are each coupled to stacking conveyor 240 and extend outward therefrom. Guide paddles 282 are spaced in pairs on stacking conveyor 240 to receive a carton 186 therebetween. In some embodiments, guide paddles 282 are removably coupled to stacking conveyor 240 to enable selective adjustment of the spacing of guide paddles 282 relative to one another. For example, and without limitation, in some embodiments, guide paddles 282 may be coupled to stacking conveyor 240 such that two stacks of cartons 186 may be received between adjacent guide paddles 282. In the example embodiment, a pair of walls 284 are coupled to base plates 280 on opposes sides of stacking conveyor 240 and are spaced to accommodate cartons 186 in a gap 286 defined therebetween. In some embodiments, walls 284 are slidably coupled to base plates 280 to enable selective adjustment of the size of gap 286.

During operation, lifting assemblies 242 are configured to move synchronously along respective tracks 276 such that each gripping mechanism 278 is positioned over stacking conveyor 240 and feed conveyors 224 at the same time as one another. For example, when cartons 186 are loaded to stacking conveyor 240, each lifting assembly 242 moves to feed conveyors 224, engages a carton 186, moves back to stacking conveyor 240, and deposits carton 186 between respective guide paddles 282 at substantially the same time as one another. In alternative embodiments, lifting assemblies 242 are operated in staggered relation relative to another such that at least one lifting assembly 242 does not engage a carton 186 at the same time at least one other lifting assembly 242.

In the example embodiment, stacking station 210 may include one or more sensors (not shown) configured to detect when cartons 186 have been deposited between guide paddles 282. In response, stacking station 210 indexes stacking conveyor 240 such that guide paddles 282 and deposited carton 186 are moved to a new position in line with an adjacent stacking conveyor 240. As a result, in the example embodiment, after a carton 186 is deposited from fourth feed conveyor 234, corresponding guide paddles 282 will include four cartons 186 stacked therebetween and will index the four cartons 186 to container wrapping station 214. In some embodiments, as described in greater detail below, stacking station 210 is configured to selectively index stacking conveyor 240 such that carton stacks including a greater number of cartons 186 than the number of feed conveyors 228-234 may be provided to container wrapping station 214. In alternative embodiment, stacking station 210 is configured to operate in any manner that enables packaging system 200 to function as described herein.

Figure 9:
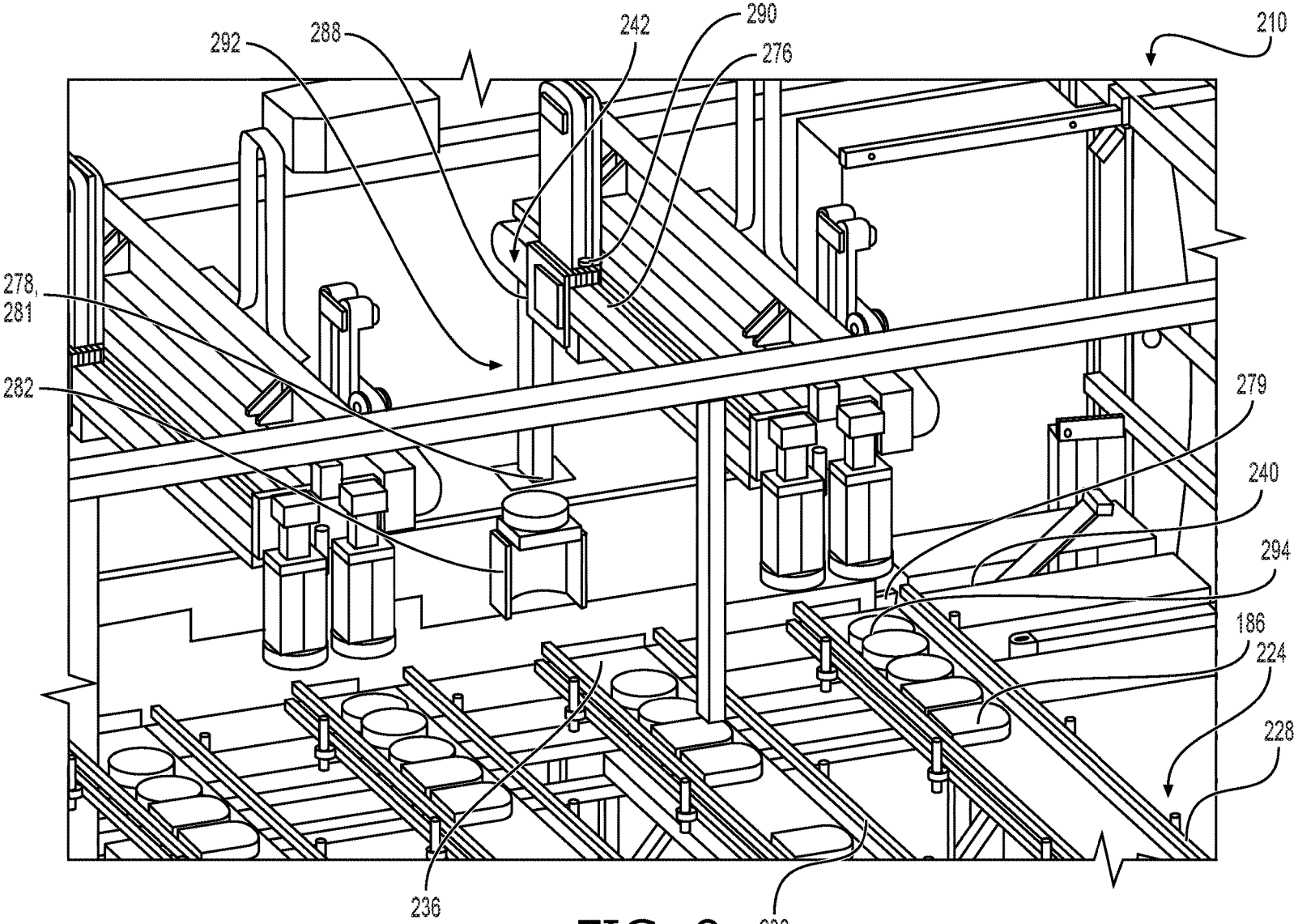
FIG. 9 is an enlarged schematic view of the line dividing conveyor and stacking station shown in FIG. 8.

FIG. 9 is an enlarged schematic view of line dividing conveyor 208 and stacking station 210. In the example embodiment, lifting assemblies 242 each include a carriage 288 having rollers 290 operable to move lifting assemblies 242 along track 276. An arm assembly 292 is coupled to carriage 288 and depends therefrom. Gripping mechanisms 278 are provided at free ends 293 of arm assemblies 292. In the example embodiment, gripping mechanisms 278 each include a pair of suction cups 294 configured to engage cartons 186. Each suction cup 294 is operably coupled to a respective independent vacuum generator (not shown) for selectively providing suction to selectively attach suction cups 294 to cover cartons 186. In alternative embodiments, at least some suction cups 294 are coupled to a common vacuum generator (not shown).

In the example embodiment, arm assemblies 292 are configured to rotate around an axis of rotation (e.g., a vertical axis as shown in FIG. 9) to facilitate pivoting orientation of cartons 186. For example, as shown in FIG. 9, a first gripping mechanism 279 engaged with a carton 186 at first feed conveyor 228 is oriented in a first orientation. A second gripping mechanism 281 proximate second feed conveyor 230 is engaged with a carton 186 at stacking station 210 and is oriented in a second orientation. In the example embodiments, arm assemblies 292 rotate approximately 90 degrees to reorient gripping mechanism 278 between the first orientation and the second orientation to facilitate reorienting cartons 186 between feed conveyors 224 and stacking conveyor 240. Moreover, in some embodiments where gripping mechanisms 278 are configured to lift a plurality of cartons 186 and deposit cartons 186 in a plurality of stacks 296, rotating arm assemblies 292 allows for cartons 186 to be lifted from feed conveyors 224 and reoriented to be positioned between guide paddles 282 when deposited on stacking conveyor 240. In alternative embodiments, any portion of lifting assemblies (e.g., gripping mechanisms 278) are configured to rotate relative to track 276 to facilitate changing the orientation of cartons 186. In yet further alternative embodiments, arm assemblies 292 are not configured to rotate relative to tracks 276.

In the example embodiment, gates 236 are each selectively moveable between a raised position (shown in FIG. 9) in which gates 236 are laterally extend across a corresponding feed conveyor 234 and hold cartons 186 from further downstream travel on corresponding feed conveyors 234, and a lowered position (not shown) wherein gates 236 do not extend across corresponding feed conveyors 234 and do not hold carton units 186 from further downstream travel, thereby permitting cartons 186 to move beyond gates 236. For example, in some embodiments, gates 236 are rotatably coupled to feed conveyors 224 and rotate approximately 90 degrees outward from belts 270 between the raised position and the lowered position. In other embodiments, gates 236 are configured to be selectively vertically lowered relative to feed conveyors 224 such that gates 236 are positioned below belts 270. During operation, after gripping mechanisms 278 engage cartons 186, gates 236 may be moved from the raised position to the lowered position and lifting assembly 242 may retract gripping mechanism 278 vertically while simultaneously moving laterally along track 276 towards stacking conveyor 240. Accordingly, in the example embodiment, lowering gates 236 to the lowered position enables simultaneous lifting and lateral movement of cartons 186 from feed conveyors 224. After gripping mechanism 278 and carton 186 clear gate 236, gate 236 may then be moved back to the raised position to prevent an adjacent carton 186 in queue from falling off feed conveyor 224. In alternative embodiments, gates 236 are maintained in the raised position and lifting assemblies 242 are operable to vertically lift cartons 186 off of feed conveyors 224, at least such that cartons 186 clear gates 236, prior to starting lateral movement toward stacking conveyor 240. In further alternative embodiments, lifting assemblies 242 are configured to lift cartons 186 from feed conveyors 224 in any manner that enables stacking station 210 to function as described herein.

Figure 10:
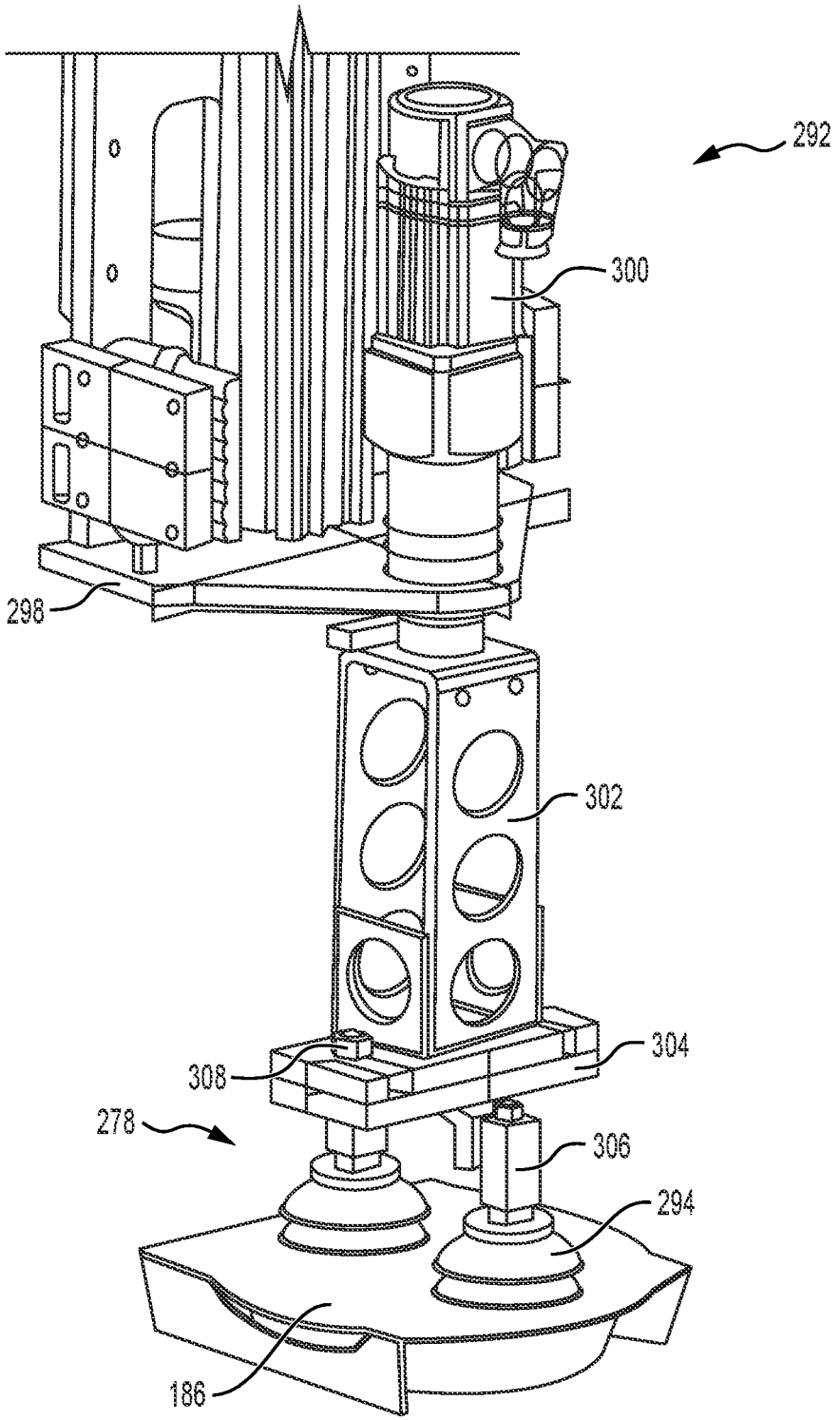
FIG. 10 is a schematic perspective view of a portion of an arm assembly for use in the stacking station shown in FIG. 8.

FIG. 10 is a schematic perspective view of a portion of arm assembly 292. In the example embodiment, arm assembly 292 includes a bracket 298. A rotating drive 300 and a support 302 are coupled to bracket 298. Gripping mechanism 278 is removably coupled to support 302 and includes a frame plate 304 and a pair of cup arms 306 coupled to frame plate 304 and depending therefrom. Suction cups 294 are each coupled to a respective one of cup arms 306. In some embodiments, arm assembly 292 may also include pneumatic tubes (not shown) configured to be coupled in flow communication with suction cups 294 and a vacuum generator (not shown).

In the example embodiment, rotating drive 300 is configured to selectively rotate support 302 within bracket 298 to enable rotation of gripping mechanism and/or cartons 186, as described above with respect to FIG. 9. In the example embodiment, rotating drive 300 is a servomotor. In alternative embodiments, rotating drive 300 may be any drive mechanism that enables arm assembly to function as described herein. In further alternative embodiments, bracket 298 is configured to rotate relative to tracks 276 (shown in FIG. 9) to facilitate selective rotation of gripping mechanism 278 and/or carton 186.

In the example embodiment, gripping mechanism 278 is removably coupled to support 302 via removable fasteners 308 (e.g., threaded bolts) extending through frame plate 304. As a result, gripping mechanism may be replaced (e.g., via an operator) by loosening fasteners 308 from frame plate 304 to decouple gripping mechanism 278 from support 302. In some embodiments, gripping mechanisms 278 may be replaced with alternative gripping mechanisms (not shown) having a greater number of suction cups 294 to enable arm assembly to lift multiple cartons 186 simultaneously. For example, and without limitation, during operation, a changeover operation may be performed on packaging system 200 to enable packaging system 200 to output pairs of carton stacks 296. To perform the changeover operation, an operator may decouple gripping mechanism 278 from support 302 and couple an alternative gripping mechanism 278 that is configured to lift two cartons 186 simultaneously. In alternative embodiment, gripping mechanism 278 is coupled to support 302 in any manner that enables arm assembly 292 to function as described herein.

Figure 11:
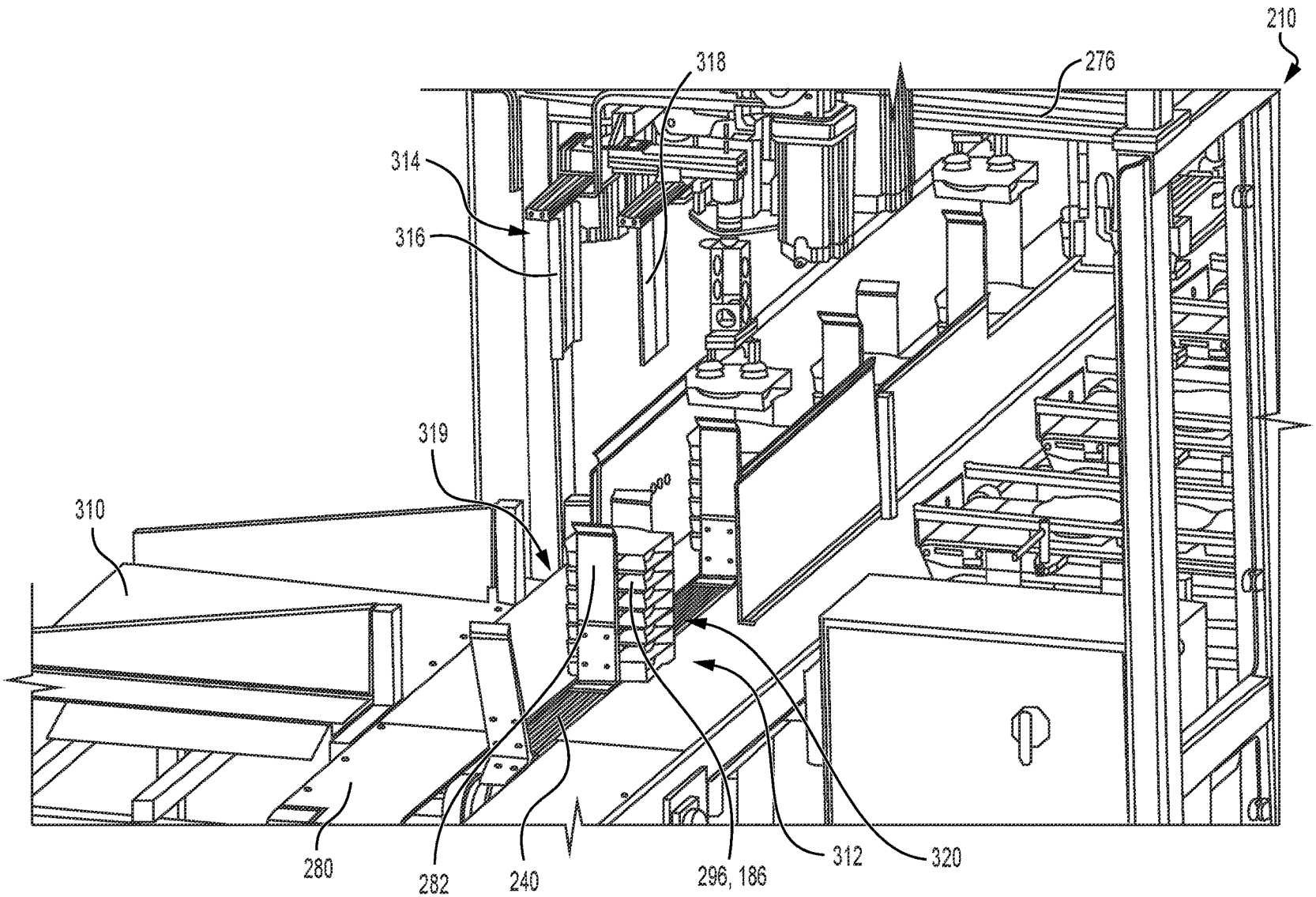
FIG. 11 is a schematic perspective view of the stacking station shown in FIG. 8.

FIG. 11 is a schematic perspective view of a portion of stacking station 210. In the example embodiment, stacking station 210 includes a dead plate 310 coupled to base plate 280 leading to container wrapping station 214 (shown in FIG. 5). Stacking conveyor 240 is configured to index stacks 296 to a loading position, indicated generally at 312, adjacent dead plate 310 after a desired number of cartons 186 have been added to stack 296 by lifting assembly 242. In the example embodiment, stack 296 includes seven cartons 186 though, in alternative embodiments, stack 296 of cartons 186 may include any desired number of cartons 186. Once stack 296 is in the loading position 312, a pushing assembly 314 is configured to move stack 296 out of paddles 282 and off of stacking conveyor 240 along dead plate 310 while maintaining cartons 186 in the stacked configuration. In particular, in the example embodiment, pushing assembly 314 is a robotic arm that is moveable laterally along a track 276. Pushing assembly 314 is substantially similar to lifting assemblies 242 (shown in FIGS. 8-9) other than as described below.

In the example embodiment, pushing assembly 314 includes a first pushing paddle 316 and a second pushing paddle 318 laterally spaced from first pushing paddle 316. Pushing assembly 314 is operable to vertically move pushing paddles 316, 318 between a raised position, as shown in FIG. 11, and a lowered position (not shown) in which first pushing paddle 316 may engage a front side 319 of stack 296 and second pushing paddle 318 engages a rear side 320 of stack 296. Although shown in the raised position in the view of FIG. 11, during operation, pushing paddles 316, 318 are moved to the lowered position prior to indexing stacking conveyor 240 such that indexing stacking conveyor 240 moves stack 296 into direct contact with paddles 316, 318. As a result, in the example embodiment, obstruction by and deformation of cartons 186 resulting from lowering pushing paddles 316, 318 over stacks 296 may be avoided. With pushing paddles 316, 318 engaged with stack 296, pushing assembly 314 may then move laterally along track 276 toward container wrapping station 214 (shown in FIG. 5) to laterally move stack 296 out of paddles 282 of stacking conveyor 240 and along dead plate 310. In some embodiments, dead plate 310 includes a belt conveyor (not shown) configured to direct stack 296 from stacking conveyor to container wrapping station 214. In further embodiments, stacking station 210 is configured to transfer stack 296 from stacking conveyor 240 to container wrapping station 214 in any manner that enables packaging system 200 to function as described herein. For example, and without limitation, in some embodiments, pushing assembly 314 is a ram (not shown) configured to engage rear side 320 of stack 296 and move stack 296 laterally out of paddles 282 and along dead plate 310.

Figure 12:
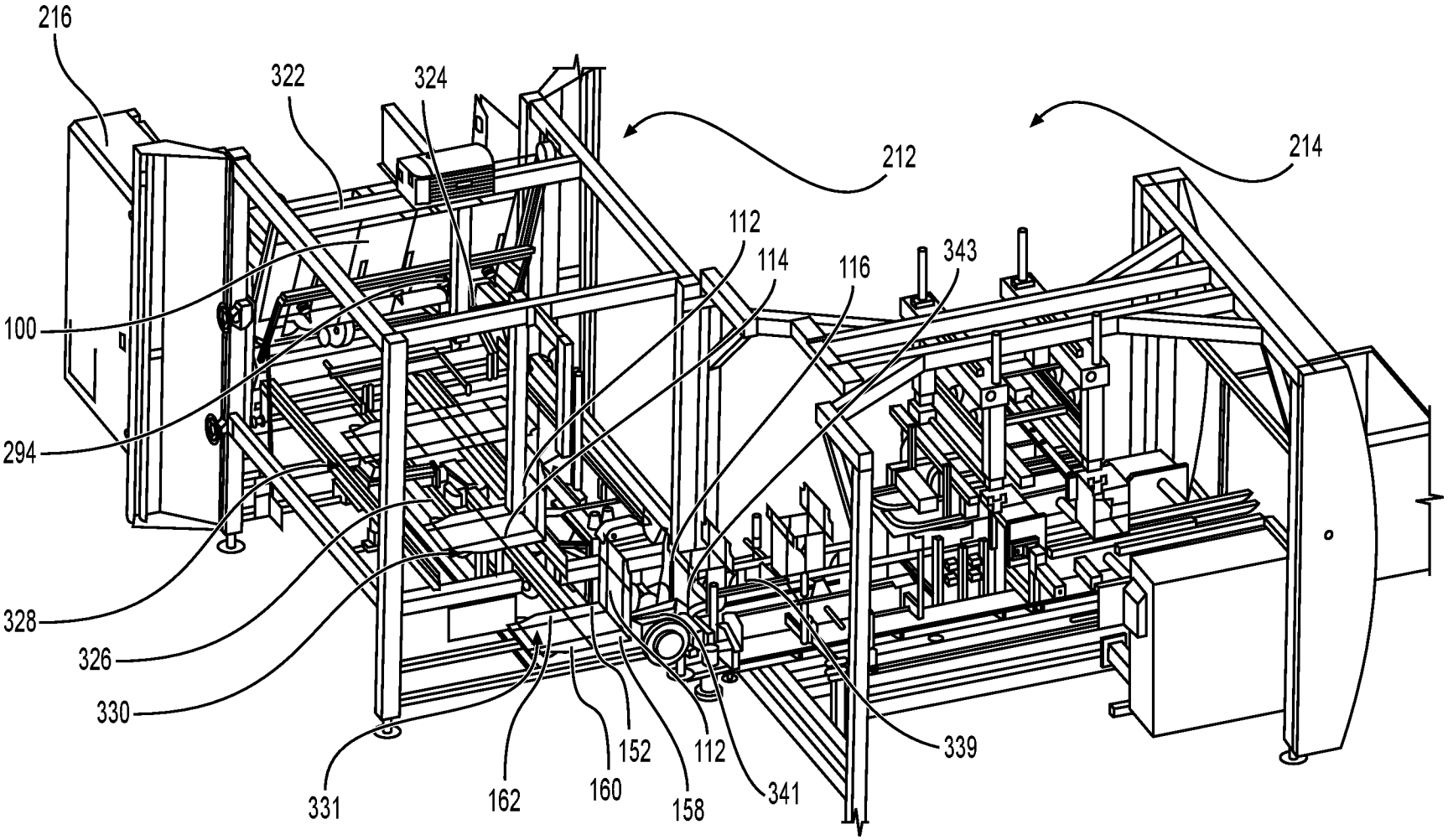
FIG. 12 is a schematic perspective view of a container loading station and a container wrapping station of the packaging system shown in FIG. 5.
Figure 13:
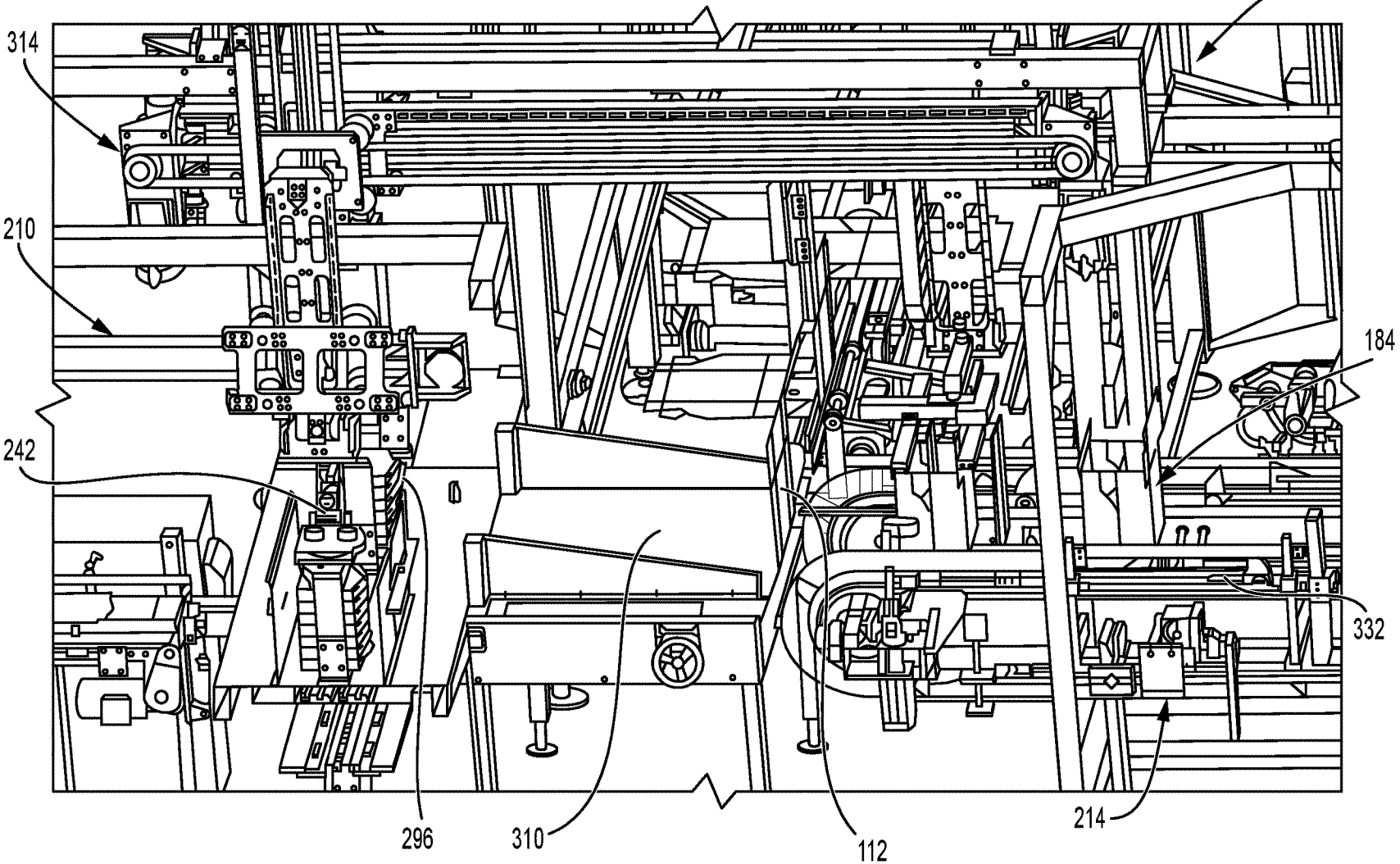
FIG. 13 is a schematic perspective view of the stacking station shown in FIG. 8 and the container loading station and container wrapping station shown in FIG. 12.
Figure 14:
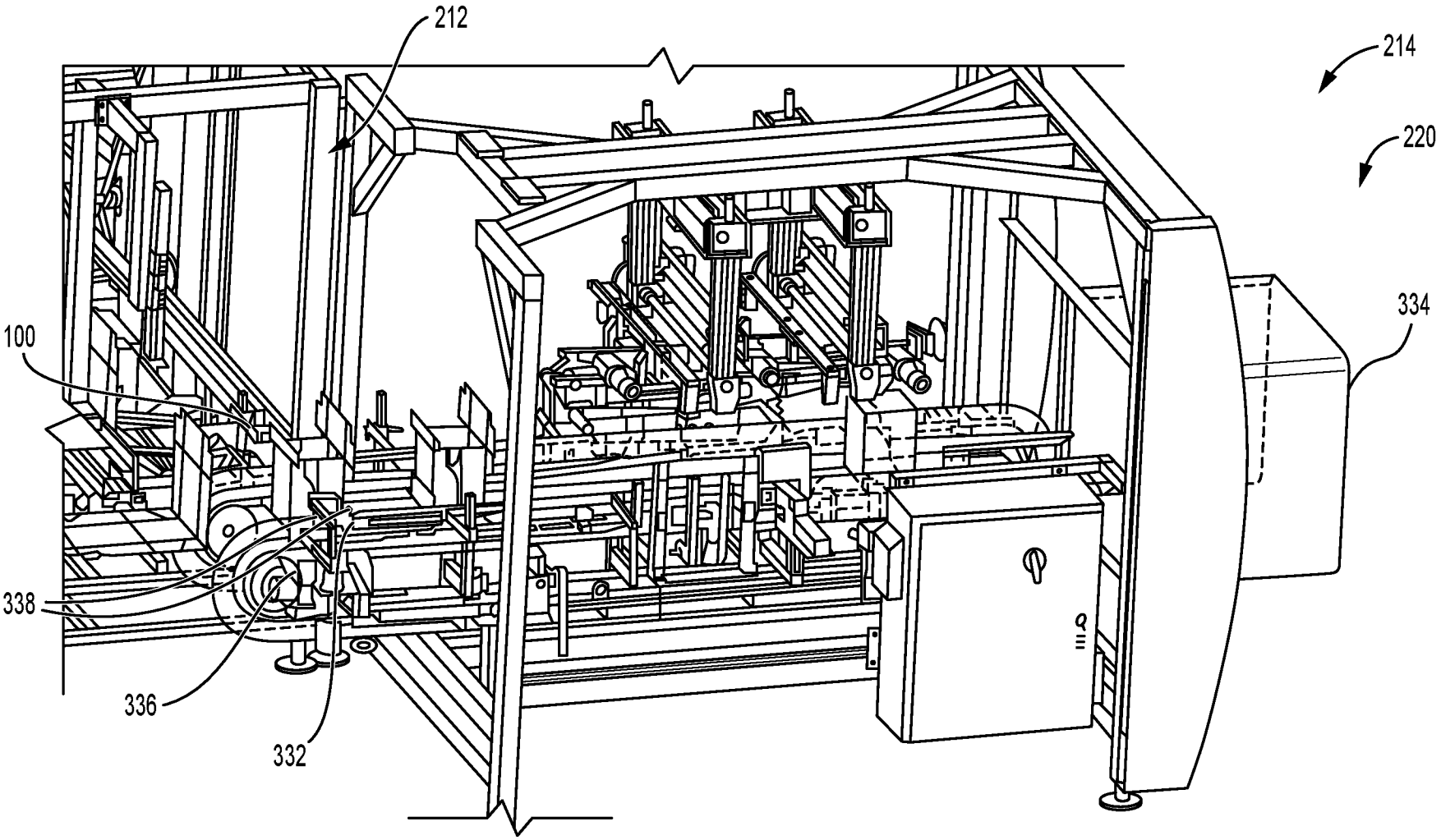
FIG. 14 is a schematic perspective view of the container wrapping station and the container loading station shown in FIG. 12.

FIG. 12 is a schematic perspective view of container loading station 212 and container wrapping station 214. FIG. 13 is a schematic perspective view of portions of stacking station 210, container loading station 212, and container wrapping station 214. FIG. 14 is a schematic perspective view of container wrapping station 214 and a portion of container loading station 212.

Referring to FIG. 12, in the illustrated example, stacking station 210 and dead plate 310 are removed for clarity. In the example embodiment, container loading station 212 includes a blank holding frame 322, a robotic pivot assembly 324, and a blank conveyor 326. Blank holding frame 322 is configured to hold a plurality of container blanks 100 in position. For example, during operation, an operator may manually load container blanks 100 onto blank holding frame 322. Robotic pivot assembly 324 is configured to engage a container blank 100 in blank holding frame 322 and pivot container blank 100 onto a blank conveyor 326. In the example embodiment, robotic pivot assembly 324 includes a plurality of suction cups 294 configured to engage container blank 100 in substantially the same manner as described above with respect to suction cups 294 (shown in FIG. 10). In alternative embodiments, robotic pivot assembly 324 is configured to move container blanks 100 onto blank conveyor 326 in any manner that enables container loading station 212 to function as described herein. In some embodiments, blank holding frame 322 may further include a selectively releasable lock (not shown) that engages container blank 100 when an adjacent container blank 100 is being lowered onto blank conveyor 326. For example, and without limitation, in some embodiments, once robotic pivot assembly 324 engages container blank 100, the lock may be released, thereby enabling robotic pivot assembly 324 to move container blank 100 onto blank conveyor 326. Moreover, the lock may subsequently engage an adjacent container blank 100 to retain the adjacent container blank 100 in blank holding frame 322 prior to robotic pivot assembly 324 engaging container blank 100.

In the example embodiment, blank conveyor 326 is a belt conveyor and is selectively controllable (e.g., via control system 216) to move container blanks 100 from blank holding frame 322 to container wrapping station 214 in discrete movements. In some embodiments, blank conveyor 326 includes a plurality of conveyors (not shown). In alternative embodiments, blank conveyor 326 is operated in continuous movement. During operation, blank conveyor 326 is selectively operable to index container blanks 100 from a first position, generally indicated at 328, where container blank 100 is deposited on blank conveyor 326 by robotic pivot assembly 324, to a second position, indicated generally at 330, at which a folding assembly (not shown) folds container blank 100 into the "L" configuration. In some embodiments, folding assembly (not shown) includes a press (not shown) and a pivoting lever (not shown). For example, in some such embodiments, when container blank 100 is in the second position 330, the press may be lowered onto second side panel 114 of container blank 100 to hold container blank 100 in position while the pivoting lever engages first end panel 112 of container blank 100 to fold container blank 100 into the "L" configuration. From the second position 330, blank conveyor 326 indexes container blank 100 to a third position 331 where container blank 100 is configured to receive stack 296 (shown in FIG. 11).

Referring to FIG. 13, in the third position 331, second side panel 114, second end panel 116, and lip panel 118 (shown in FIG. 1) are positioned beneath dead plate 310 of stacking station 210. Pushing assembly 314 may then move stack 296 that has been indexed from lifting assembly 242 along dead plate 310 such that stack 296 contacts first end panel 112 of container blank 100. In some embodiments, pushing assembly 314 is further configured to push stack 296 from dead plate 310 with container blank 100 into container wrapping station 214, or more specifically, onto a wrapping conveyor 332 of container wrapping station 214. In the example embodiment, as stack 296 contacts container blank 100 and is moved to wrapping conveyor 332, second side panel 114 (shown in FIG. 1) is moved out from under dead plate 310 such that second side panel 114 supports stack 296 and is positioned between stack 296 and wrapping conveyor 332.

Referring to FIG. 14, in the example embodiment, wrapping conveyor 332 is selectively controllable (e.g., via control system 216) to move packaging assemblies 184 including stacks 296 (shown in FIG. 13) and container blanks 100 from to a deposit housing 334 at endpoint 220 of packaging system 200. In particular, in the example embodiment, wrapping conveyor 332 is a chain conveyor including a pair of looped chains 336 positioned on opposed sides of packaging assemblies 184. Looped chains 336 each include a plurality of lugs 338 spaced on the looped chains 336 which engage and carry packaging assemblies 184 along wrapping conveyor 332.

In the example embodiment, lugs 338 are spaced on chains 336 such that a first pair of lugs 339 engage first end panel 112 and a second pair of lugs 341 engage second end panel 116. In particular, in the example embodiment, as packaging assembly 184 is loaded onto wrapping conveyor 332, second pair of lugs 341 engage and fold second end panel 116. Container wrapping station 214 further includes a plurality of side arms 343 which engage and fold first top end panel 152 first bottom end panel 154 second top end panel 162 and second bottom end panel 160 inward to at least partially surround stacks 296 within container blanks 100. In the example embodiment, wrapping conveyor 332 is configured to be operated in discrete movements. That is, wrapping conveyor 332 is configured to carry packaging assemblies 184 in a start/stop operation. In alternative embodiments, wrapping conveyor 332 is configured to operate continuously such that lugs 338 are in continuous motion between dead plate 310 and endpoint 220.

Figure 15:
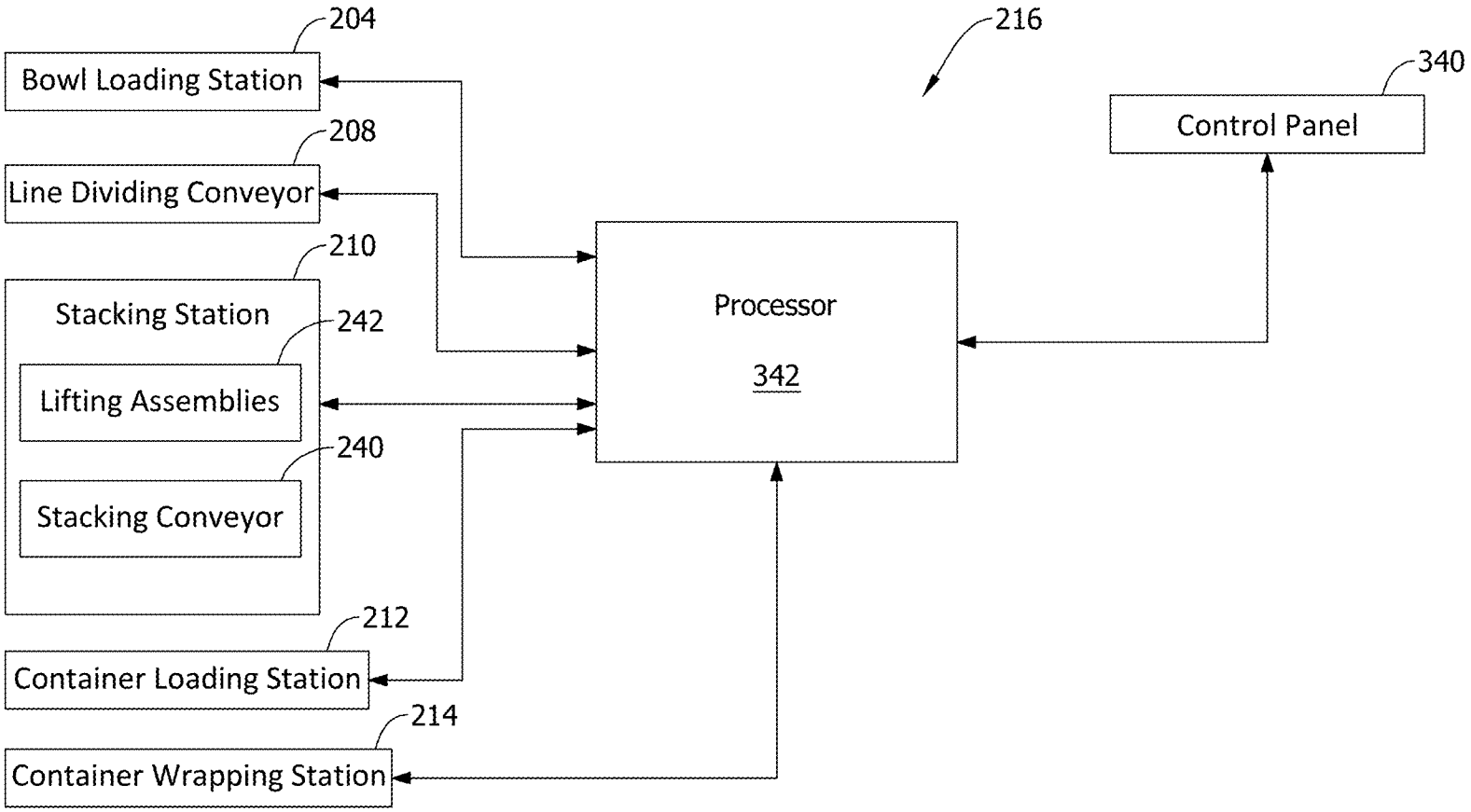
FIG. 15 is a block diagram of a control system for use with the packaging system shown in FIG. 5.

FIG. 15 is a block diagram of an example control system 216 that may be used with packaging system shown in FIG. 5. In the example embodiment, control system 216 includes at least one control panel 340 and at least one processor 342, or more broadly a controller. In certain embodiments, reprogrammed recipes or protocols embodied on a non-transitory computer-readable medium are programmed in and/or uploaded into processor 342 and such recipes include, but are not limited to, predetermined speed and timing profiles, wherein each profile is associated with forming blank assemblies from container blanks and carton blanks each having a predetermined size and shape.

In the example embodiment, bowl loading station 204, line dividing conveyor 208, stacking station 210 including lifting assemblies 242 and stacking conveyor 240, container loading station 212, and container wrapping station 214 are integrated with control system 216, such that control system 216 is configured to transmit signals to each to control its operation.

In certain embodiments, control system 216 is configured to facilitate selecting a speed and/or timing of the movement and/or activation of the devices and/or components associated with each of bowl loading station 204, line dividing conveyor 208, stacking station 210, container loading station 212, and container wrapping station 214. The devices and/or components may be controlled either independently or as part of one or more linked mechanisms. In certain embodiments, control panel 340 allows an operator to select a recipe that is appropriate for a particular packaging assembly 184. The operator typically does not have sufficient access rights/capabilities to alter the recipes, although select users can be given privileges to create and/or edit recipes. Each recipe is a set of computer instructions that instruct packaging system 200 as to forming packaging assembly 184. For example, and without limitation, packaging system 200 may instructed as to speed and timing of input conveyor 202, line conveyor 222, output conveyor 226, feed conveyors 224, stacking conveyor 240, container blank conveyor 326, and wrapping conveyor 332.

Figure 16:
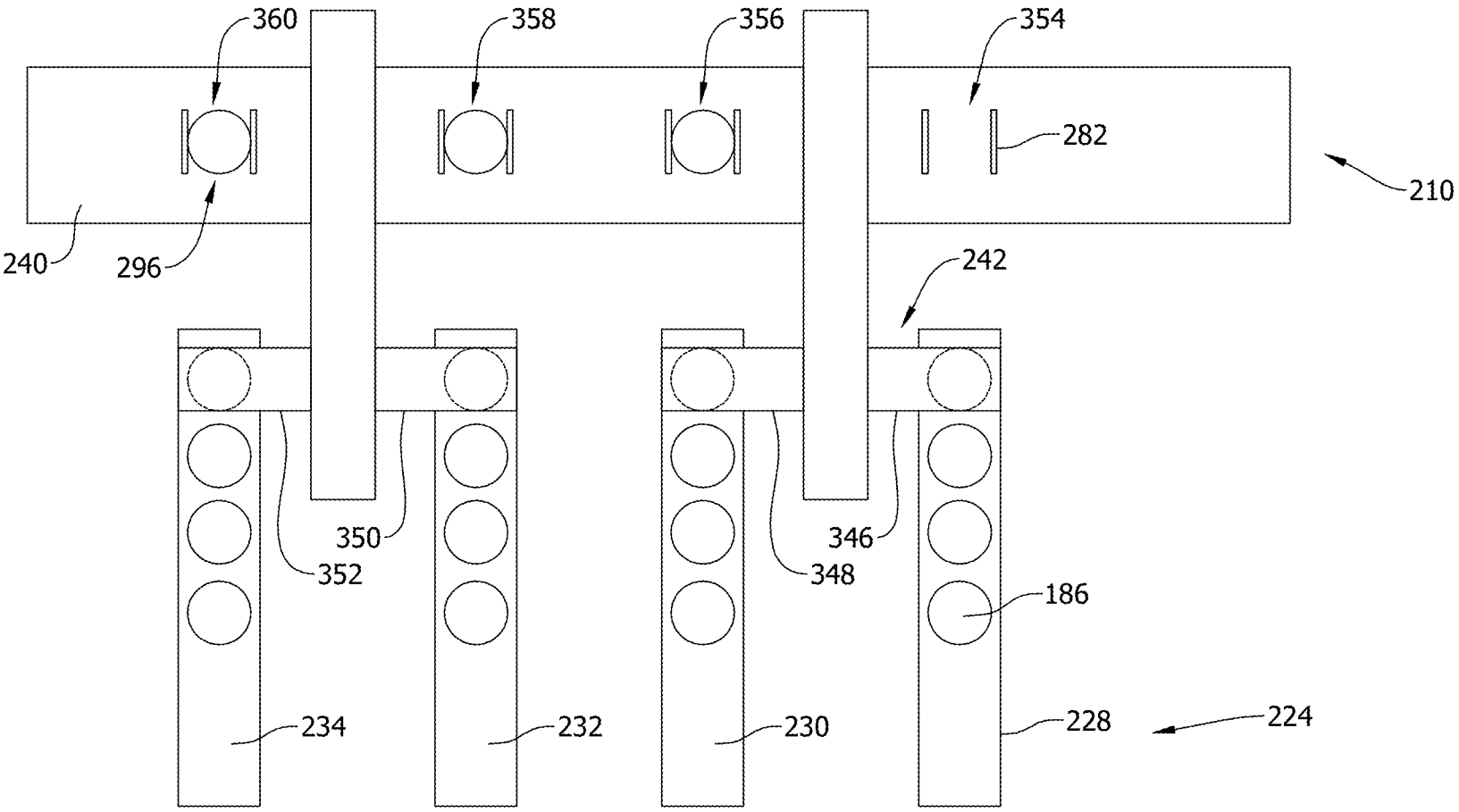
FIG. 16 is a top schematic view of the line dividing conveyor and stacking station shown in FIG. 8 including lifting assemblies in a retrieve position.
Figure 17:
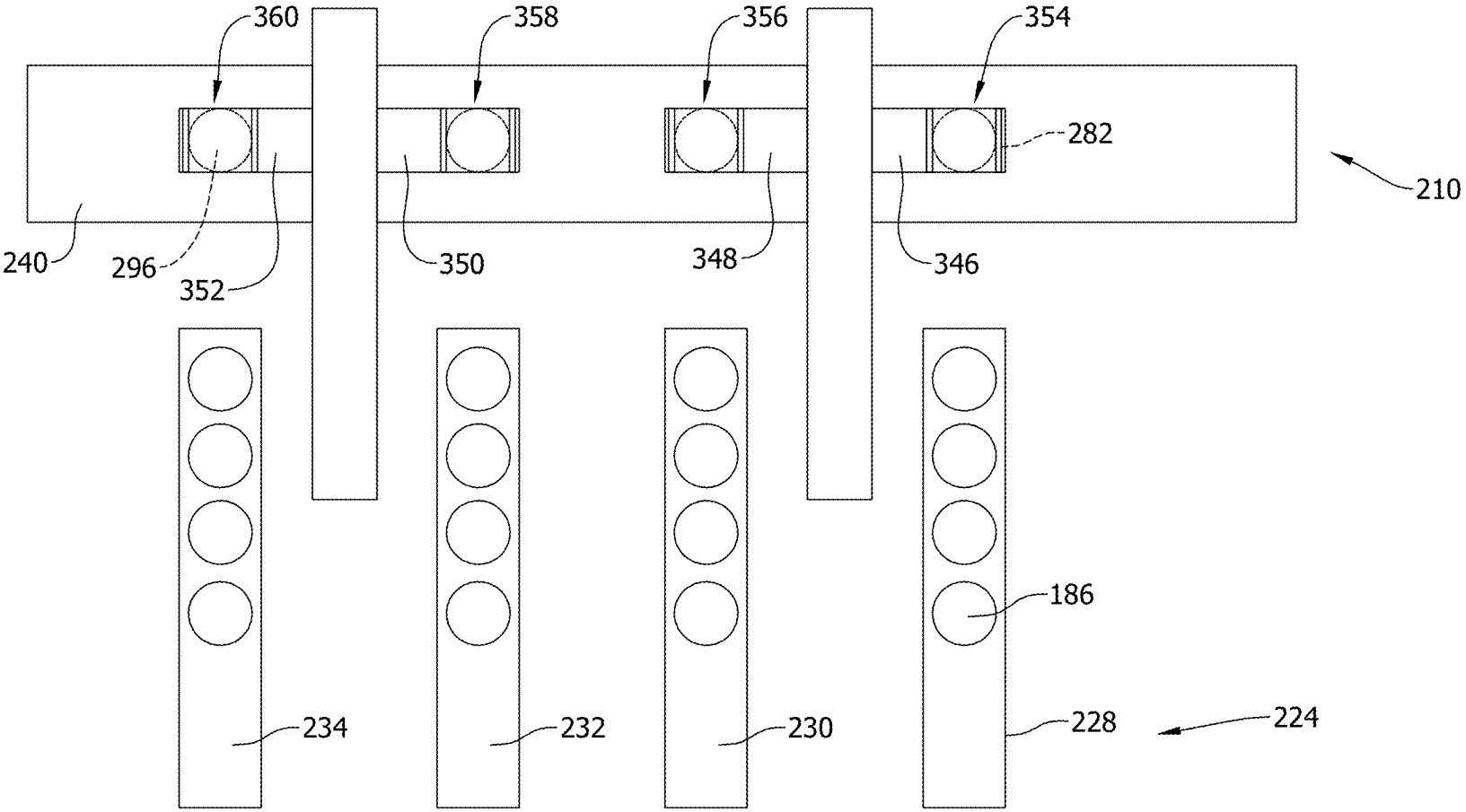
FIG. 17 is a top schematic view of the line dividing conveyor and stacking station shown in FIG. 16 with the lifting assemblies in a deposit position.

FIG. 16 is a top schematic view of feed conveyors 224 and stacking station 210 showing lifting assemblies 242 in a retrieve position. FIG. 17 is a top schematic view of feed conveyors 224 and stacking station 210 showing lifting assemblies 242 in a deposit position. In the example embodiment, plurality of lifting assemblies 242 include a first lifting assembly 346, a second lifting assembly 348, a third lifting assembly 350, and a fourth lifting assembly 352. First lifting assembly 346 is configured to retrieve cartons 186 from first feed conveyor 228 and deposit cartons 186 at a first region 354 of stacking conveyor 240. Second lifting assembly 348 is configured to retrieve cartons 186 from second feed conveyor 230 and deposit cartons 186 at a second region 356 of stacking conveyor 240. Third lifting assembly 350 is configured to retrieve cartons 186 from third feed conveyor 232 and deposit cartons 186 at a third region 358 of stacking conveyor 240. Fourth lifting assembly 352 is configured to retrieve cartons 186 from fourth feed conveyor 234 and deposit cartons 186 at a fourth region 360 of stacking conveyor 240. In embodiments where stacking conveyor 240 is operated to output stacks 296 having a number of cartons 186 equal to the number of conveyors 224 (e.g., stacks 296 of four cartons 186 in the example embodiment) prior to lifting assemblies 242 depositing cartons 186 (as shown in FIG. 16), first region 354 does not include cartons 186, second region 356 includes one carton 186, third region 358 includes a stack 296 of two cartons 186, and fourth region 360 includes a stack 296 of three cartons 186. After cartons 186 are deposited, stacking conveyor 240 is indexed to move stacks 296 to an adjacent region. Accordingly, in embodiments where stacking conveyor 240 is operated to output stacks 296 having a number of cartons 186 equal to the number of conveyors 224, after cartons 186 are deposited (as shown in FIG. 17), and prior to indexing stacking conveyor 240, first region 354 includes one carton 186, second region 356 includes a stack of two cartons 186, third region 358 includes three cartons 186, and fourth region 360 includes four cartons 186.

In example embodiment, lifting assemblies 242 are controlled to move synchronously such that each lifting assembly 242 retrieves a carton 186 from the corresponding conveyor 224 and deposits cartons 186 at corresponding regions 354-360 at substantially the same time. In alternative embodiments, lifting assemblies 242 are operated in asynchronously such that at least one lifting assembly 242 does not engage a carton 186 at the same time at least one other lifting assembly 242. For example, in some embodiments, second lifting assembly 348 is controlled such that, as first lifting assembly 346 deposits a carton 186 at first region 354, second lifting assembly 348 is carrying a carton 186 between second feed conveyor 230 and second region 356. In further alternative embodiments, lifting assemblies 242 may be controlled to operate relative to one another in any manner that enables lifting assemblies 242 to function as described herein.

As described above, in the example embodiment, during operation, lifting assemblies 242 are configured to move synchronously such that each lifting assembly 242 retrieves a carton 186 from the corresponding conveyor 224 and deposits the carton 186 in the corresponding region at substantially the same time. However, in some embodiments, during an initial start-up operation, only some lifting assemblies 242 may be operated to ensure only stacks 296 having a desired number of cartons 186 are output from stacking conveyor 240. For example, in some embodiments, when packaging system 200 is started, each region 354-360 may not include any cartons 186. Accordingly, in some such embodiments, a startup operation is performed to output the desired number of cartons 186 from stacking conveyor 240. During startup operation, a first operation is performed wherein only first lifting assembly 346 retrieves and deposits a carton 186 in first region 354. Stacking conveyor 240 is then indexed, moving the deposited carton 186 from first region 354 to second region 356. Subsequently, a second operation is run wherein only first lifting assembly 346 and second lifting assembly 348 retrieve and deposit a carton 186. This process is repeated, with one additional lifting assembly 242 retrieving and depositing a carton 186 with each indexation of stacking conveyor 240, until all lifting assemblies 242 are operating. Thus, in the example embodiment, when startup operation is completed, stacking conveyor 240 is has a standard loading of cartons 186. As used herein, the term "standard loading" refers to first region 354 of stacking conveyor 240 including one carton 186, second region 356 including two cartons 186, third region 358 including three cartons 186, and fourth region 360 including four cartons 186.

In the above described operation, the stacks 296 output by stacking conveyor 240 include four cartons 186 corresponding to the four feed conveyors 224 and the four lifting assemblies 242. However, in some implementations of packaging system 200, it may be desirable to output stacks 296 from stacking conveyor 240 that have a greater number of cartons 186 than the number of feed conveyors 224 and/or lifting assemblies 242. In such embodiments, stacking station 210 may selectively index stacking conveyor 240 to achieve the desired number of cartons 186 in stacks 296 without having to hold running one of lifting assemblies 242. As used herein, "running" or a "run" of lifting assemblies 242 refers to lifting assemblies 242 retrieving a carton 186 from the corresponding conveyor 222 and depositing the carton 186 at the corresponding region 354-360.

Figure 18:
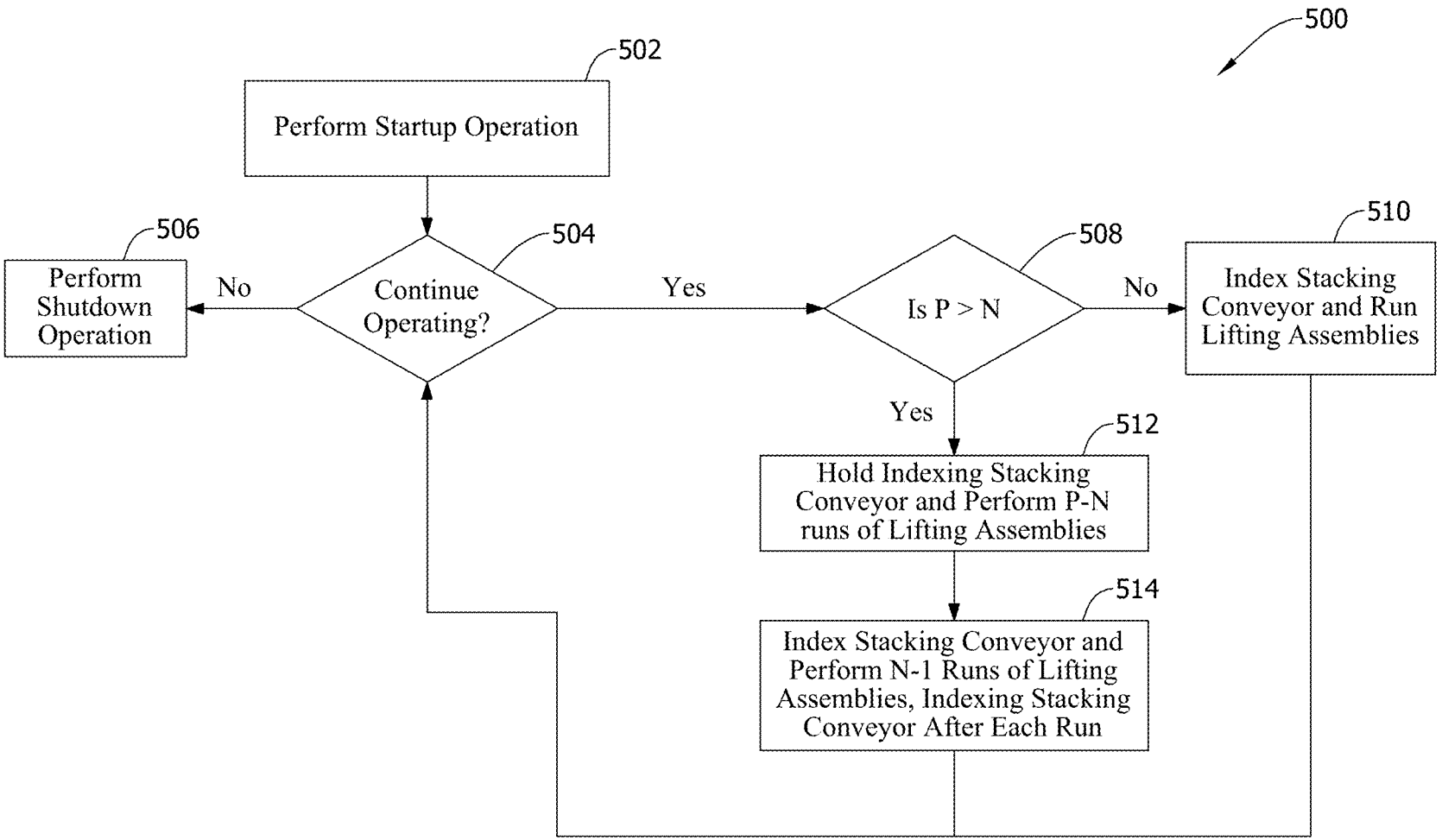
FIG. 18 is a flow chart showing an example method for controlling the lifting assemblies and stacking station shown in FIG. 16.

FIG. 18 is a flow chart showing an example method 500 for controlling lifting assemblies 242 and stacking conveyor 240 (e.g., via control system 216) based on outputting stacks 296 including a desired number of cartons 186. Initially, at step 502 the above described startup operation is performed substantially as described above such that stacking conveyor 240 has a standard loading of cartons 186 where first region 354 includes one carton 186, second region 356 includes two cartons 186, third region 358 includes three cartons 186, and fourth region 360 includes four cartons 186. At step 504 control system 216 determines whether to continue operating. In some embodiments, the decision whether to continue operating is based on whether a predetermined packaging system 200 output has been reached or will be reached subsequent performance of a shutdown operation. If operation is not continued, a system shutdown operation is performed at step 506. In the example embodiment, system shutdown operation is substantially the same as startup operation operated in reverse. In other words, in the example embodiment, during the shutdown operation, stacking conveyor 240 is indexed and first lifting assembly 346 is then put on hold while second, third, and fourth lifting assemblies are each run, such that there are no cartons 186 in first region, there are two cartons 186 in second region 356, there are three cartons in the fourth region 360 and there are four cartons 186 in fourth region. Stacking conveyor 240 is then again indexed and first and second lifting assemblies 242 are put on hold while only third 350 and fourth 352 lifting assemblies are run. This process is repeated, holding an additional lifting assembly 242 after each run, until there are no cartons 186 in fourth region 360 and fourth lifting assembly 352 is put on hold and/or powered off.

If operation is continued, method proceeds to step 508. At step 508 control system 216 determines whether the desired number of cartons 186 in output stacks 296 (represented by "P") is greater than the number of feed conveyors 224 and/or lifting assemblies 242 (represented by "N"). Desired number of cartons P may be based on a user-input (e.g., received via control panel 340) and/or based on a predetermined number of cartons 186 saved in processor 342. If desired number of cartons P are not greater than N, such as for example, in the above described example where desired number of cartons P in stacks 296 and number of lifting assemblies 242 are both four, method proceeds to step 510. At step 510, stacking conveyor 240 is indexed, each of lifting assemblies 242 are run. After lifting assemblies 242 are run, method 500 returns to step 504 and method 500 is repeated.

Where the desired output number of cartons P in a stack 296 is greater than N, method 500 proceeds to step 512. At step 512, control system 216 performs P-N runs of each lifting assembly 242 without indexing stacking conveyor 240. For example, in one operation where P is five and N is four, after startup operation is completed, stacking station 210 holds stacking conveyor 240 in position while performing one additional run of lifting assemblies 242 such that first region 354 includes two cartons 186, second region 356 includes three cartons 186, third region 358 includes four cartons 186, and fourth region 360 includes five cartons 186. In another operation where P is seven and N is four, after startup operation is completed, stacking station 210 holds stacking conveyor 240 in position while performing an additional three runs of lifting assemblies 242 such that first region 354 includes four cartons 186, second region 356 includes five cartons 186, third region 358 includes six cartons 186, and fourth region 360 includes seven cartons 186.

After stacking station 210 performs the P-N number of runs of lifting assemblies 242, method proceeds to step 514. At step 514, stacking conveyor 240 is indexed, outputting the stack 296 of P number of cartons 186 in fourth region 360 to container wrapping station 214 (shown in FIG. 12). For example, in the above described embodiment where P is five and N is four, stack 296 of five cartons 186 in fourth region 360 are indexed to stacking conveyor 240. As a result, after indexing stacking conveyor 240, first region 354 will has no cartons 186, second region 356 has two cartons 186, third region 358 has three cartons 186, and fourth region 360 has four cartons 186. Each lifting assembly 242 performs a run such that first region 354 has one carton 186, second region 356 has three cartons 186, third region 358 has four cartons 186, and fourth region 360 has five cartons 186. Stacking conveyor 240 is subsequently indexed, outputting the stack of five cartons 186 from fourth region 360 to wrapping station 214. This process is repeated for a total of N−1 (e.g., three in the example embodiment) runs of lifting assemblies 242, with stacking conveyor 240 being indexed after each run. In the example embodiment, after N−1 runs have been performed, there are is one carton 186 in first region 354, two cartons 186 in second region 356, three cartons 186 in third region 358, and four cartons 186 in fourth region 360. Method 500 then proceeds back to step 504 and method 500 is repeated.

In the above described method, the startup operation is initially performed such that stacking conveyor 240 has a standard loading of cartons 186. However, in some embodiments, an alternative startup operation may be used to provide various loading configurations of stacking conveyor 240. For example, and without limitation, in one example where a desired number of cartons 186 in output stacks 296 is seven, an alternative startup operation may be performed to provide an alternative loading of stacking conveyor 240 where there are two cartons 186 in first region 354, four cartons 186 in second region 356, six cartons 186 in third region 358, and seven cartons 186 in fourth region 360. Stacking conveyor 240 may be selectively indexed such that, over a period of successive runs, such that only stacks 296 of seven cartons 186 are output from fourth region 360.

The above described methods allows for outputting stacks 296 from stacking conveyor 240 having a greater number of cartons 186 then lifting assemblies 242 and/or feed conveyors 224 without requiring one of lifting assemblies 242 to be either put on hold or operated without retrieving and depositing a carton 186 (i.e., "dry-cycled"). Accordingly, in the example method, throughput of packaging system 200, and more particularly, throughput of stacking conveyor 240 is improved by each lifting assembly 242 continuously operating and carrying a carton 186 to stacking conveyor 240 once the start-up operation is completed.

Figure 19:
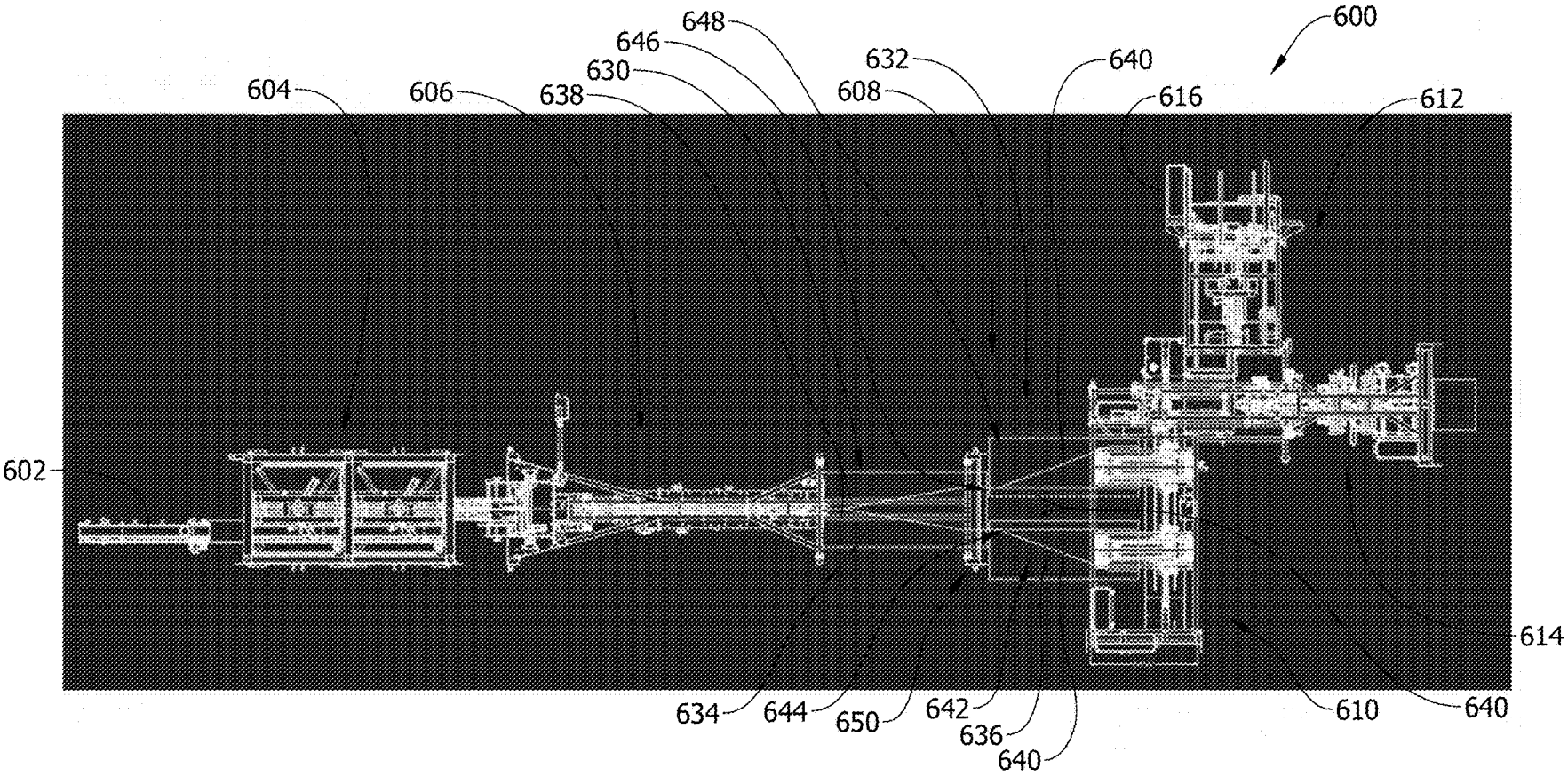
FIG. 19 a schematic top view of an alternative packaging system for forming the packaging assembly shown in FIGS. 2-4.

FIG. 19 a schematic top view of an alternative packaging system 600 that may be used to form the packaging assembly 184 shown in FIGS. 2-4. Packaging system 600 includes an input conveyor 602, a bowl loading station 604, a carton wrapping station 606, a line dividing conveyor 608, a stacking station 610, a container loading station 612, and a container wrapping station 614. Directional arrows shown in FIG. 19 indicate directional flow of materials through packaging system 600 forming packaging assembly 184 (shown in FIG. 3). A control system 616 is coupled in operative control communication with certain components of packaging system 600. Packaging system 600 is substantially the same as packaging system 200 described above with respect to FIGS. 5-18 except as described below.

In the example embodiment, line dividing conveyor 608 is a linear diverting conveyor. In particular, in the example embodiment, line dividing conveyor 608 includes an output line 630 configured to receive cartons 186 output from carton wrapping station 606 and a feed line 632 extending between output line 630 and stacking station 610. Output line 630 includes a first belt 634 directing cartons 186 to feed line 632 and feed line 632 includes a second belt 636 directing cartons 186 (shown in FIG. 2) to stacking station 610, or more specifically, to gates (e.g., similar to gates 236 shown in FIG. 9) positioned within stacking station 610. In alternative embodiments, first belt 634 and second belt 636 are a single continuous belt (not shown).

In the example embodiment, output line 630 includes a pair output guides 638 positioned above first belt 634 configured to guide cartons 186 along to feed line 632. Feed line 632 includes a plurality of feed guides 640 which collectively define a first feed conveyor 642, a second feed conveyor 644, a third feed conveyor 646 and a fourth feed conveyor 648 of feed line 632.

In the example embodiment, line dividing conveyor 608 includes a robotic pivot mechanism 650 coupled to output guides 638 and configured to selectively pivot output guides 638 relative to output line 630 to facilitate selectively directing cartons 186 to one of feed lines 642-648. In some embodiments, line dividing conveyor 608 further includes one or more sensors (not shown) configured to detect a number of cartons 186 in the respective feed lines 642-648. In such embodiments, line dividing conveyor 608 is configured to direct cartons 186 (via robotic pivot mechanism 650) onto one of feed lines 642-648 based at least in part on the detected number of cartons 186 in each of feed lines 642-648 to ensure a substantially equal distribution of cartons 186 are apportioned among feed lines 642-648. In particular, line dividing conveyor 608 is configured to direct cartons 186 onto feed lines 642-648 such that each feed line 642-648 has at least one carton 186 in a respective stacking queue at all times during operation. For example, where sensors (not shown) detect that fourth feed line 648 includes the lowest number of cartons 186 in a stacking queue, line dividing conveyor 608 is configured to direct a next carton 186 from first output line 630 to fourth feed line 648.

In alternative embodiments, line dividing conveyor 608 is configured to direct cartons 186 from output conveyor 626 to one of feed lines 642-648 in any manner that enables packaging system 600 to function as described herein. For example, and without limitation, in some embodiments, line dividing conveyor 608 includes a plurality of pivot plates (not shown) configured to selectively pivot relative to at least one of first belt 634 and second belt 636 to direct cartons 186 to one of feed lines 642-648.

The example embodiments described herein provide a packaging system that advantageously facilitates formation of a packaging assembly having a plurality of stacked cartons contained within a container blank having a tear line. More specifically, the example embodiments described herein facilitate providing access to an end user to each of the cartons stacked within the container.

Example embodiments of methods and a system for packaging stacked products are described above in detail. The methods and system are not limited to the specific embodiments described herein, but rather, components of systems and/or steps of the methods may be utilized independently and separately from other components and/or steps described herein. For example, the system may also be used in combination with other blanks, and is not limited to practice with only the blanks described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A packaging system comprising:

a plurality of parallel feed conveyors configured to carry a plurality of carton units thereon in a first direction;

a stacking station including a stacking conveyor and a plurality of lifting assemblies, said stacking conveyor configured to carry stacks of carton units in a second direction perpendicular to the first direction, each lifting assembly of said plurality of lifting assemblies being selectively moveable over said stacking conveyor and one corresponding feed conveyor of said plurality of parallel feed conveyors; and a controller communicatively coupled to said stacking conveyor and said plurality of lifting assemblies, said controller configured to:

control a first lifting assembly of said plurality of lifting assemblies to (i) retrieve a first carton unit using a first gripping mechanism of said first lifting assembly, and (ii) vertically lift the first carton unit from a first feed conveyor of said plurality of parallel feed conveyors while the first carton unit is engaged with said first gripping mechanism; and control said first lifting assembly to (iii) vertically lower the first carton unit while the first carton unit is engaged with said first gripping mechanism, and (iv) deposit the first carton unit, by releasing the first carton unit from the first gripping mechanism, on said stacking conveyor on top of a second carton unit previously deposited on said stacking conveyor in a stacked relationship with the second carton unit, wherein said first gripping mechanism is the same gripping mechanism engaged with the first carton unit during the vertical lifting from the first feed conveyor.

2. The packaging system of claim 1, said first feed conveyor comprises a gate moveable between a raised position wherein said gate laterally extends across said first feed conveyor and holds the first carton unit from further downstream travel on said first feed conveyor, and a lowered position, wherein said gate does not extend across said first feed conveyor holding the first carton unit from further downstream travel.

3. The packaging system of claim 2, wherein said controller is further configured to control said gate to move from the raised position to the lowered position after controlling said first lifting assembly to retrieve the first carton unit from said first feed conveyor.

4. The packaging system of claim 1, wherein said first gripping mechanism includes at least one suction element configured to engage the first carton unit.

5. The packaging system of claim 1, wherein said stacking conveyor is configured to be indexed discretely, and wherein said controller is further configured to control said stacking conveyor to index after controlling said first lifting assembly to deposit the first carton unit on said stacking conveyor.

6. The packaging system of claim 5, wherein said stacking conveyor comprises a plurality of guide pairs configured to receive the cartons units therein, and wherein said controller is configured to index said stacking conveyor such that each feed conveyor of said plurality of parallel feed conveyors is aligned with at least one corresponding guide pair of said plurality of guide pairs when in a stacking position.

7. The packaging system of claim 1, wherein said controller is configured to control each lifting assembly to simultaneously retrieve at least one carton unit from each of said corresponding feed conveyors.

8. The packaging system of claim 1, wherein said stacking station comprises a track for supporting said first lifting assembly extending from said stacking conveyor to said first feed conveyor, said first lifting assembly being coupled to said track and configured for selective rotation relative thereto, wherein said first lifting assembly retrieves the first carton unit in a first orientation, and wherein said controller is further configured to control said first lifting assembly, after retrieving the first carton unit, to rotate the first carton unit 90° from the first orientation to a second orientation.

9. The packaging system of claim 8, wherein said controller is configured to control said first lifting assembly to deposit the first carton unit on said stacking conveyor in the second orientation.

10. The packaging system of claim 1, wherein said stacking station is configured to output stacks of carton units, each stack comprising a respective plurality of stacked carton units, and wherein said plurality of stacked carton units each comprise a greater number of stacked carton units than a number of lifting assemblies of said plurality of lifting assemblies.

11. The packaging system of claim 10, wherein said controller is further configured to control said plurality of lifting assemblies such that said lifting assemblies are continuously being moved to either retrieve a carton unit from the corresponding conveyor or deposit a carton unit at said stacking conveyor.

12. The packaging system of claim 11, wherein said lifting assemblies are controlled to operate at substantially the same speed.

13. A method for forming a plurality of carton unit stacks using a packaging system, the packaging system including a plurality of parallel feed conveyors and a stacking station including a stacking conveyor configured to convey carton unit stacks in a first direction and a plurality of lifting assemblies, the lifting assemblies each being selectively moveable over the stacking conveyor and one corresponding feed conveyor of the plurality of parallel feed conveyors, said method comprising:

providing a first carton unit on a first feed conveyor of the plurality of parallel feed conveyors;

carrying, by the first feed conveyor, the first carton unit in a second direction towards the stacking station, the second direction perpendicular to the first direction;

retrieving, by a first lifting assembly of the plurality of lifting assemblies, the first carton unit from the first feed conveyor using a first gripping mechanism of the first lifting assembly;

vertically lifting the first carton unit from the first feed conveyor while the first carton unit is engaged with the first gripping mechanism;

vertically lowering the first carton unit while the first carton unit is engaged with the first gripping mechanism; and depositing, by the first lifting assembly, the first carton unit, by releasing the first carton unit from the first gripping mechanism, on the stacking conveyor on top of a second carton unit previously deposited on the stacking conveyor in a stacked relationship with the second carton unit, wherein the first gripping mechanism is the same gripping mechanism engaged with the first carton unit during said vertically lifting.

14. The method of claim 13, wherein said retrieving the first carton unit from the first feed conveyor comprises engaging, via the first gripping mechanism of the first lifting assembly, the first carton unit.

15. The method of claim 14 further comprising moving, after said engaging the first carton unit, a gate of the first feed conveyor from a raised position, wherein the gate laterally extends across the first feed conveyor and holds the first carton unit from further downstream travel on the first feed conveyor, to a lowered position, wherein the gate does not extend across the first feed conveyor holding the first carton unit from further downstream travel.

16. The method of claim 13 further comprising indexing, discretely, the stacking conveyor after said depositing the first carton unit on the stacking conveyor.

17. The method of claim 16 wherein said indexing the stacking conveyor comprises moving at least one guide pair from a first position, in which the at least one guide pair is aligned with the first feed conveyor, to a second position, in which the at least one guide pair is aligned with a second feed conveyor of the plurality of parallel feed conveyors.

18. The method of claim 13, wherein the first carton unit is oriented in a first orientation on the first feed conveyor prior to said retrieving, wherein said method further comprises rotating, after retrieving the first carton unit, the first lifting assembly to rotate the first carton unit 90° from a first orientation to a second orientation, and wherein said depositing the first carton unit on the stacking conveyor comprises depositing the first carton unit in the second orientation.

19. The method of claim 18 further comprising controlling each lifting assembly of the plurality of lifting assemblies to each continuously retrieve and deposit a carton unit from a corresponding feed conveyor.

20. A packaging system comprising:

a plurality of parallel feed conveyors configured to carry a plurality of carton units thereon in a first direction;

a stacking station including a stacking conveyor and a plurality of lifting assemblies, said stacking conveyor configured to carry stacks of carton units in a second direction perpendicular to the first direction, each lifting assembly of said plurality of lifting assemblies being selectively moveable along a corresponding track over said stacking conveyor and one corresponding feed conveyor of said plurality of feed conveyors; and a controller communicatively coupled to said stacking conveyor and said plurality of lifting assemblies, said controller configured to:

control a first lifting assembly of said plurality of lifting assemblies to retrieve a first carton unit in a first orientation using a first gripping mechanism of said first lifting assembly and vertically lift the first carton unit from a first feed conveyor of said plurality of parallel feed conveyors while the first carton unit is engaged with said first gripping mechanism;

control said first lifting assembly to rotate the first carton unit 90° about a vertical axis from the first orientation to a second orientation; and control said first lifting assembly to vertically lower the first carton unit while the first carton unit is engaged with said first gripping mechanism and deposit the first carton unit on the stacking conveyor in the second orientation by releasing the first carton unit from said first gripping mechanism, wherein said first gripping mechanism is the same gripping mechanism engaged with the first carton unit during the vertical lifting from the first feed conveyor.

* * * * *